US006462264B1

(12) United States Patent
Elam

(10) Patent No.: US 6,462,264 B1
(45) Date of Patent: Oct. 8, 2002

(54) METHOD AND APPARATUS FOR AUDIO BROADCAST OF ENHANCED MUSICAL INSTRUMENT DIGITAL INTERFACE (MIDI) DATA FORMATS FOR CONTROL OF A SOUND GENERATOR TO CREATE MUSIC, LYRICS, AND SPEECH

(76) Inventor: Carl Elam, 9521 Horn Ave., Baltimore, MD (US) 21236

( * ) Notice: Subject to any disclaimer, the term of this patent is extended or adjusted under 35 U.S.C. 154(b) by 0 days.

(21) Appl. No.: 09/361,498

(22) Filed: Jul. 26, 1999

(51) Int. Cl.[7] ..... G10H 7/00

(52) U.S. Cl. ..... 84/645; 341/60; 704/258

(58) Field of Search ..... 84/645; 341/60; 704/258

(56) References Cited

U.S. PATENT DOCUMENTS

| | | | | | |
|---|---|---|---|---|---|
| 4,942,551 | A | | 7/1990 | Klappert et al. | 364/900 |
| 5,054,360 | A | | 10/1991 | Lisle et al. | 84/645 |
| 5,099,738 | A | | 3/1992 | Hotz | 84/617 |
| 5,171,930 | A | | 12/1992 | Teaney | 84/725 |
| 5,235,124 | A | | 8/1993 | Okamura et al. | 84/601 |
| 5,321,200 | A | | 6/1994 | Yamamoto | 84/645 |
| 5,410,100 | A | | 4/1995 | Kim | 84/645 |
| 5,416,526 | A | * | 5/1995 | Yamamoto | 84/645 X |
| 5,450,597 | A | | 9/1995 | Klappert et al. | 395/800 |
| 5,499,922 | A | | 3/1996 | Umeda et al. | 434/307 |
| 5,530,859 | A | | 6/1996 | Tobias, II et al. | 395/650 |
| 5,561,849 | A | * | 10/1996 | Mankovitz | 84/645 X |
| 5,574,949 | A | * | 11/1996 | Tsurumi | |
| 5,576,507 | A | * | 11/1996 | LaMarra | 84/645 |
| 5,596,159 | A | | 1/1997 | O'Connell | 84/622 |
| 5,606,143 | A | | 2/1997 | Young | 84/600 |
| 5,616,878 | A | | 4/1997 | Lee et al. | 84/645 |
| 5,637,822 | A | * | 6/1997 | Utsumi et al. | 84/645 |
| 5,640,590 | A | | 6/1997 | Luther | 395/806 |

(List continued on next page.)

OTHER PUBLICATIONS

*Reference Data for Radio Engineers*, 1976, pp. 37–31 through 37–37; Howard W. Sams & Co., Inc.
*Speech*, 1995; pp. 1–7; Grolier Electronic Publishing Inc.
*Phonetics*, 1995; p. 5; Grolier Electronic Publishing Inc.
*The International Phonetic Alphabet*.
Weiss, S. Merrill; *The Dawning Era of Packetization* in TV Technology; Jun. 1994; pp. 25–27.
Weiss, S. Merrill; *The Packetization of Advanced TV* in TV Technology; Jul. 1994; pp. 19–21.
Weiss, S. Merrill; *Making Packetized Television Work* in TV Technology; Aug. 1994; pp. 43–44; 66.
C–Cube Microsystems Product Catalog Fall 1994; *Chapter 2 MPEG Overview*, pp. 17–28.
C–Cube Microsystems Product Catalog Fall 1994; *Chapter 10 CL9110 MPEG 2 Transport Layer Demultiplexer*, pp. 81–85.
Taub, Schilling; *Principles of Communication Systems* 2 ed., 1986, pp. 249–271; 298–314; 533–564.

(List continued on next page.)

*Primary Examiner*—Jeffrey Donels
(74) *Attorney, Agent, or Firm*—Law Offices of Royal W. Craig

(57) ABSTRACT

A method and apparatus for the transmission and reception of broadcasted instrumental music, vocal music, and speech using digital techniques. The data is structured in a manner similar to the current standards for MIDI data. Transmitters broadcast the data to receivers which contain internal sound generators or an interface to external sound generators that create sounds in response to the data. The invention includes transmission of multiple audio data signals for several languages on a conventional radio and television carrier through the use of low bandwidth data. Error detection and correction data is included within the transmitted data. The receiver has various error compensating mechanisms to overcome errors in data that cannot be corrected using the error correcting data that the transmitter sent. The data encodes for elemental vocal sounds and music.

29 Claims, 15 Drawing Sheets

U.S. PATENT DOCUMENTS

| | | | | | |
|---|---|---|---|---|---|
| 5,655,144 | A | | 8/1997 | Milne et al. | 395/807 |
| 5,670,732 | A | * | 9/1997 | Utsumi et al. | 84/645 |
| 5,672,838 | A | | 9/1997 | Lee et al. | 84/645 |
| 5,680,512 | A | | 10/1997 | Rabowsky et al. | |
| 5,691,495 | A | | 11/1997 | Fujimori | 84/618 |
| 5,700,966 | A | * | 12/1997 | LaMarra | 84/645 |
| 5,734,119 | A | * | 3/1998 | France et al. | 84/645 X |
| 5,852,251 | A | * | 12/1998 | Su et al. | 84/645 |
| 5,864,080 | A | | 1/1999 | O'Connell | 84/622 |
| 5,867,497 | A | * | 2/1999 | Fujimori et al. | |
| 5,883,957 | A | * | 3/1999 | Moline et al. | |
| 5,886,275 | A | * | 3/1999 | Kato et al. | 434/307 A X |
| 5,899,699 | A | * | 5/1999 | Kamiya | |
| 5,915,237 | A | | 6/1999 | Boss et al. | |
| 5,928,330 | A | * | 7/1999 | Goetz et al. | |
| 5,933,430 | A | * | 8/1999 | Osakabe et al. | |
| 5,977,468 | A | * | 11/1999 | Fujii | 84/645 X |
| 5,982,816 | A | * | 11/1999 | Ogita et al. | |
| 5,991,693 | A | * | 11/1999 | Zalewski | |
| 6,067,566 | A | * | 5/2000 | Moline | |
| 6,069,310 | A | * | 5/2000 | James | 84/645 |
| 6,088,733 | A | * | 7/2000 | Kikuchi | |
| 6,121,536 | A | * | 9/2000 | Malcolm | 84/645 |
| 6,143,973 | A | * | 11/2000 | Kikuchi | 84/645 |
| 6,246,672 | B1 | * | 6/2001 | Lumelsky | 704/260 X |

OTHER PUBLICATIONS

*The Complete MIDI 1.0 Detailed Specification*; Published by The MIDI Manufactures Association, 1996. NOTE: Various pages in Section 6 and Section 7 have been omitted.

Rychner, Walker; *The Next MIDI Book: Starting With the Numbers* vol. 2; 1991.

Massey; *The MIDI Home Studio*; 1988.

Macon, et al.; *Concatenation–based MIDI–to–Singing Voice Synthesis*, Presented at 103rd Meeting of the Audio Engineering Society, Sep. 1997.

Macon, et al.; A Singing Voice Synthesis System Based on Sinusoidal Modeling, *Proceedings of the International Conference on Acoustics, Speech, and Signal Processing*; vol. 1, pp. 435–438, May 1997.

"Speech Concatenation and Synthesis Uusing an Overlap–Add Sinusoidal Model" By: Michael Macon and Mark Clements.

"Authorizing Tools for Speech Synthesis Using the Sable Markup Standard" By: Johan Waters, Brian Rundle and Michael Macon.

"Generalization and Discrimination in Tree–Structured Unit Selection" By: Michael Macon, Andrew Cronk, and Johan Wouters.

"Personalizing a Speech Sythesizer by Voice Adaption" By: Andrew Kain and Mike Macon.

"Optimizing Stopping Criteria for Tree–Based Unit Slection in Concatenative Synthesis" By: Andrew Cronk and Michael Macon.

"Text–to–Speech Voice Adaptation from Sparse Training Data" By: Alexander Kain and Michael Macon.

"A Perceptual Evaluation of Distance Measure for Concatentative Speech Synthesis" By: Johan Wouters and Michael Macon.

"Universal Speech Tools: The CSLU Toolkit" By: Stephen Sutton et. al.

"Technical Report: OGlresLPC: Diphome Synthesizer using Residual–Excited Linear Prediction" By: Michael Macon, Andrew Cronk, Johan Wouters, and Alex Kain.

* cited by examiner

FIGURE 2

| Status Byte with Channel # | Command Function | Number of Data Bytes | Meaning of Data Bytes |
|---|---|---|---|
| 1000xxxx = 80 thru 8F hexadecimal | Note Off | 2 | Note Number and Release Velocity |
| 1001xxxx = 90 thru 9F hexadecimal | Note On | 2 | Note Number and Attack Velocity |
| 1010xxxx = A0 thru AF hexadecimal | Key Aftertouch Pressure | 2 | Note Number and Pressure |
| 1011xxxx = B0 thru BF hexadecimal | Controller Data | 2 | Controller Number and Value |
| 1100xxxx = C0 thru CF hexadecimal | Program Change | 1 | Program Number |
| 1101xxxx = D0 thru DF hexadecimal | Channel Aftertouch | 1 | Pressure Value |
| 1110xxxx = E0 thru EF hexadecimal | Pitch Bend | 2 | Value LSB and Value MSB |
| 1111xxxx = F0 thru FF hexadecimal | System Control | n | Quantity of Data Depends Upon Message |

| | | |
|---|---|---|
| Auxiliary MIDI Data Paths 53 | Path #1 = | Instrumental Music (NTSC Lines 11, 12, 13) (MIDI Channels 1-10) |
| | Path #2 = | Vocal Lead, English Language (NTSC Lines 22, 23, 24) (MIDI Channel 11) |
| | Path #3 = | Vocal Backup, English Language (NTSC Lines 25, 26, 27) (MIDI Channel 12) |
| | Path #4 = | Vocal Lead, Spanish Language (NTSC Lines 28, 29, 30) (MIDI Channel 11) |
| | Path #5 = | Vocal Backup, Spanish Language (NTSC Lines 31, 32, 33) (MIDI Channel 12) |
| Program Related MIDI Data Paths 52 | Path #6 = | Current Program Voice, Spanish Language (NTSC Lines 34, 35, 36) (MIDI Channel 13) |
| | Path #7 = | Current Program Voice, French Language (NTSC Lines 37, 38, 39) (MIDI Channels 14) |
| | Path #8 = | Current Program Instrumental Music (NTSC Lines 40, 41, 42) (MIDI Channels 1-10) |

FIGURE 8

METHOD AND APPARATUS FOR AUDIO BROADCAST OF ENHANCED MUSICAL INSTRUMENT DIGITAL INTERFACE (MIDI) DATA FORMATS FOR CONTROL OF A SOUND GENERATOR TO CREATE MUSIC, LYRICS, AND SPEECH

(b) CROSS-REFERENCE TO RELATED APPLICATIONS

None

(c) STATEMENT REGARDING FEDERALLY SPONSORED RESEARCH OR DEVELOPMENT

N/A

(d) REFERENCE TO MICROFICHE

N/A

(e) BACKGROUND OF THE INVENTION

1. Field of the invention

This invention relates to a method and apparatus for broadcasting of instrumental music, vocal music, and speech using digital techniques. The data is structured in a manner similar to the current standards for MIDI (Musical Instrument Digital Interface) data. The MIDI data is broadcasted to receivers which contain internal sound generators or an interface to external sound generators that create sounds in response to the MIDI data.

2. Description of Related Art

Current broadcast techniques for radio and television utilize both analog and digital techniques for audio program broadcasting. For NTSC television, a subcarrier which is FM modulated provides the sound conveyance. For conventional radio broadcasting, either AM or FM modulation of a carrier is utilized to convey the audio program. For satellite broadcast systems, digital modulations, such as QPSK, are used.

To a greater or lesser degree, these various media all share several limitations inherent in audio program broadcasting. First, their broadcast signals are subject to noise interference, and multipath fading. Second, the bandwidth of the audio program may be severely restricted by regulation, as in the case of AM radio. Third, for low frequency AM radio stations, with restricted antenna heights, the bandwidth of the RF carrier with program modulation will be severely restricted by a high-Q, narrow bandwidth transmitting antenna. Fourth, where high data rate digital broadcasts are used for either television or radio broadcasting, the data will be very vulnerable to error by multipath corruption.

Because of these limitations, the various broadcast systems normally restrict their transmission to a single audio program in order to reduce their bandwidth and improve the received signal to noise ratio. For this reason broadcasters are generally restricted to broadcasting only one specific language and must therefore limit the listening audience to which they appeal in multi-cultural urban areas.

(f) BRIEF SUMMARY OF THE INVENTION

This invention will overcome the above limitations and problems by providing multiple audio data signals for several languages on a conventional radio and television carrier through the use of low bandwidth MIDI data. The term MIDI data used in this invention refers to a variation of standard MIDI data format that, in addition to providing conventional instrumental and other commands, also includes one or more of the following: vocal commands, error detection data, error correction data, and time-tag data. Although this invention is described by using the current standard MIDI data format as a convenient basis, other data formats may be used provided they convey the same types of data information for the control and operation of sound generators at receivers.

Use of MIDI data enables the data rates to be greatly reduced and thus permits the inclusion of large quantities of error correction data. This feature will help overcome random and burst errors in the data transmission. Other novel data processing features are also included in the receiver processor to mitigate any data errors which remain uncorrected by the error correction process.

Furthermore, standard MIDI data also does not currently provide for generation of vocal sounds, except for vocal "Ohh" and "Ahh". As such, it is not capable of encoding the lyrics of a song or encoding speech. This invention solves this problem too, by providing for the transmission of vocal music and speech data for control of a voice synthesizer at the receiver. It is an object of this invention that the data encode for elemental speech sounds.

It is an object of this invention to broadcast MIDI data over FM and AM radio frequencies and over VHF and UHF television frequencies, as well as other electromagnetic frequencies.

It is an object of this invention to have the MIDI data rates very low, thereby making the broadcast signals relatively immune to multipath corruption.

It is an object of this invention to have a method of broadcasting one or several audio programs, in one or more languages, using data which controls and operates a sound generator within, or connected to, a receiver. It is also an object of the invention that the broadcast signal contains data commands which control and operate a sound generator which itself creates the music, lyrics, and speech rather than the signal which is broadcast actually conveying the audio signal waveforms.

It is an object of this invention of having a method of transmitting data that is divided into accumulator periods, of identifying within each accumulator period that each datum occurs, labeling each datum to indicate the time within the accumulator period that each datum occurs, and transmitting the data to a remote receiver. It is further an object of this invention that the data can encode for multiple languages. It is further an object of this invention that the data can encode for multiple programs. It is further an object of this invention that the accumulator periods be grouped into data paths, or data streams. It is further an object of this invention that the accumulator periods are labeled to indicate in which data path the accumulator periods belong.

It is also an object of the invention that for a given vocalist MIDI data for vocal "note-off" commands which are immediately followed by a vocal "note-on" command are deleted by the transmitter prior to transmission. It is also an object of this invention that error detection and correction data are encoded along with the MIDI data and is broadcast from the transmitter to allow for detection and correction of corrupted MIDI data.

It is also an object of this invention that a transmitter processor receives the MIDI data from a data source and divides the MIDI data into accumulator periods, adds time tag bytes to each MIDI datum within each accumulator period, groups the accumulator periods into data paths. It is further an object that for a given vocalist the transmitter processor deletes any MIDI vocal "note-off" command which is immediately followed by a MIDI vocal "note-on" command. It is an object of this invention that the transmitter processor passes the data to the data combiner processor. It is also an object of this invention that a data combiner processor adds error detection and correction data, and labels the accumulator period to identify the beginning and end of the accumulator periods and to identify which data path each accumulator period belongs.

It is an object of this invention that the data is divided up into accumulator periods at the transmitter. It is further an object that an accumulator period lasts 64/60 seconds in duration. It is another object of this invention that an accumulator period contains 64 data fields which are joined together to form a packet of data. It is another object of the invention that data is labeled with a time tag byte at the transmitter which identifies the time within each accumulator period the data occurs within an accumulator period.

It is an object of this invention that, at the transmitter, error correction and detection data is added to the data, time tag bytes are added to the data, and the data is divided into accumulator periods.

It is an object of this invention for the receiver to have a tuner which can determine if MIDI data is present and isolate that MIDI data. It is also an object of the invention for the receiver to have a receiver processor that detects and corrects errors in the MIDI data and then sends the MIDI data to a sound generator or to a command translator which modifies the MIDI data for usage by an external sound generator which in turn passes the MIDI data to an interface connector for output to an external sound generator. It is an object of this invention that the internal sound generator and external sound generator utilize any available technique such as synthesizer techniques and/or sampled waveforms stored in memory to generate the sounds.

It is another object of this invention that if errors occur in the MIDI data, the receiver processor can detect the errors and either correct the incoming MIDI data or output default MIDI data to ensure proper control of a sound generator.

It is further an object of this invention that the receiver has anti-ciphering logic to mitigate the effects of lost MIDI data by inserting new MIDI data to ensure proper control and operation of the sound generator. Because about one-half of all MIDI data is error detection and error correction data, this invention is extremely robust, permitting the accurate production of sound even under poor broadcasting conditions.

It is an object of the invention that the receiver processor utilizes the time tag byte to place the MIDI data into its correct relative time position within each accumulator period. It is an object of the invention that time tag bytes are utilized to place the data into its correct relative position within each accumulator period by the receiver.

It is an object of this invention that the MIDI data is grouped into a plurality of data paths or data streams. It is further an object of this invention that one data path can contain a sound track distinct from the sound track carried on another data path. In such a manner, one data path may contain the instrumental music for a song, a second data path may contain the lead vocal part in one language, a third data path may contain the backup vocals in the same language, a fourth data path can contain the lead vocal part in a different language, and the fifth data path contain the backup vocals in that second language. It is also an object of the invention that the listener can select, using a user control, which data paths the listener wants to hear. The user control may include a visual display or use the receiver's display for providing instructions and information to the user. It is further an object to permit the receiver processor to pass the MIDI data in the chosen data paths to the sound generator which emits the sounds. Thus, this invention makes possible the conventional English language transmission of a program with MIDI data conveying the vocals in two other languages (French and Spanish, for example). In other words, this invention permits the conveyance of second and third languages for the same program or song because the data rates are low.

It is an object of this invention that the receiver processor utilizes the packet header to determine to which data path each accumulator period belongs. It is an object of this invention that at the receiver the packet header is utilized to determine the beginning and end of each accumulator period and to determine which data path each accumulator period belongs.

It is an object of this invention that the receiver processor, under user control, can censor vocal sounds or words by selectively blocking specific words, phrases, or sounds which the listener desires to refrain from being heard or played. It is further an object that the receiver processor compares the received MIDI data encoding for words with those MIDI data encoding for words deemed to be undesirable and inhibiting the output of those MIDI data or substituting the undesirable MIDI data with other MIDI data encoding for acceptable words. It is also an object of this invention that selected words, sounds, or other noises can be selectively blocked at the receiver from being generated by the sound generator. It is also an object of this invention that words and sounds can be substituted at the receiver for selected words and sounds by substituting the data encoding for the new words and sound for the selected words and sounds.

It is also an object of this invention that the receiver processor, under user control, can adjust selectively the sound level of the data paths containing voice signals and even adjust selectively the level of certain phonemes for enhanced clarity of speech and also do the same for the vocal parts within a song. This feature may be particularly beneficial to persons with hearing impairments. It is an object of the invention that the receiver processor alters the velocity byte of the selected MIDI data to adjust the sound level. It is also an object of this invention that the velocity byte for selected sounds or words can be adjusted at the receiver, thereby adjusting the loudness of the generated sounds encoded by the data.

It is also another object of this invention that the bit error rate can be determined at the receiver. It is also an object that the average note length for each data path and MIDI channel can be determined at the receiver. Further, the receiver can compare the bit error rate to pre-determined values. It is an object of this invention that when the bit error rate reaches certain pre-determined values, specific MIDI data commands can be suppressed at the receiver. It is a further object that other MIDI commands can be substituted for the suppressed MIDI commands. It is also an object that a time delay is determined and that the time delay can be based upon the value of the received data error rate. It is a further object that when the time delay expires, specific MIDI commands are generated at the receiver. It is further an object that the time delay can be a function of the instrumental music note length, vocal music note length, and/or duration of elementary speech sounds for each data path or MIDI channel.

It is an object of this invention to have a receiver capable of receiving transmitted data which encodes for commands for the generation of sound by a sound generator. It is an object of the invention that the receiver have a tuner capable of detecting the data and a receiver processor for the processing of the data. It is a further object that the receiver have a user control and a receiver clock. It is also an object that the receiver have an internal sound generator and/or be able to be connected to an external sound generator via a command translator and an interface connector. It is a further object that the sound generators utilize any available technique such as synthesizer techniques and/or sampled waveforms to generate the sounds encoded in the received data.

It is an object of this invention that the receiver selectively adds for a given vocalist, new MIDI vocal "note-off" commands immediately preceding MIDI vocal "note-on" commands prior to sending the MIDI data to a sound generator. It is also an object of this invention that at the receiver vocal "note-off" commands are added immediately before vocal "note-on" commands prior to sending the data to a sound generator.

(g) BRIEF DESCRIPTION OF THE SEVERAL VIEWS OF THE DRAWINGS

FIG. 2 is a chart showing standard MIDI data.

FIG. 8 is a chart showing the functional assignments for eight MIDI data paths within a television broadcast signal.

(h) DETAILED DESCRIPTION OF THE INVENTION

First, the invention will be described for television. Then the differences for radio will be explained. Finally, three data examples will be supplied which support the structure of this invention. Although this invention is described by using the standard MIDI data format and MIDI sound generators as a convenient basis, other differing data formats and equipment may be used, provided they convey the same types of information for the control and operation of sound generators at receivers.

In this invention the term "MIDI" is broader than what is commonly understood in the art field. In this invention, the term "MIDI" also includes one or more of the following: error detection, error correction, timing correction (time tag data) and vocal capabilities as well as including standard MIDI data capabilities. References which are limited to the MIDI data which is commonly known in the art field will be referred to as "standard MIDI data". Vocal capability is achieved by producing MIDI data which controls the production of vocal phoneme sounds at various pitches within the sound generators. Phoneme sounds are produced for both vocal music and speech.

Figure 1:
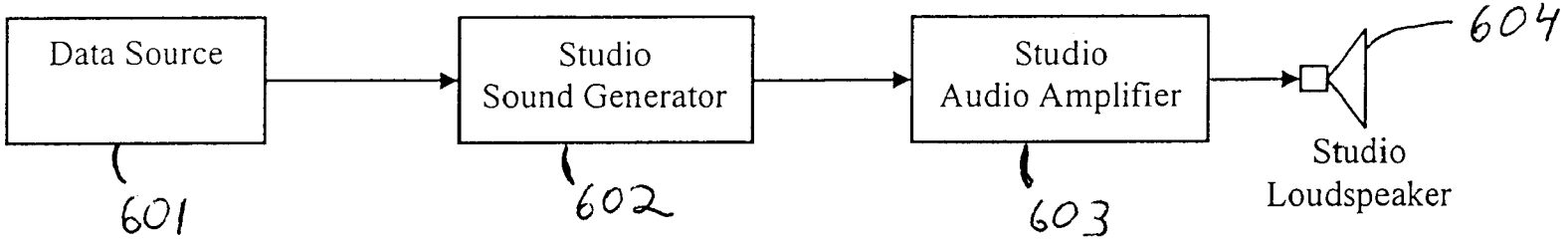
FIG. 1 is a block diagram for producing MIDI music real-time in a studio setting.

Referring to FIG. 1, in studio applications of MIDI data, a data source 601 sends instrumental and vocal command data real time to a studio sound generator 602 which generates audio waveforms. The studio sound generator 602 may utilize either sampled waveform techniques or waveform synthesis techniques to generate the audio waveforms. These audio waveforms are then sent to a studio audio amplifier 603 and studio loudspeaker 604.

Figure 3:
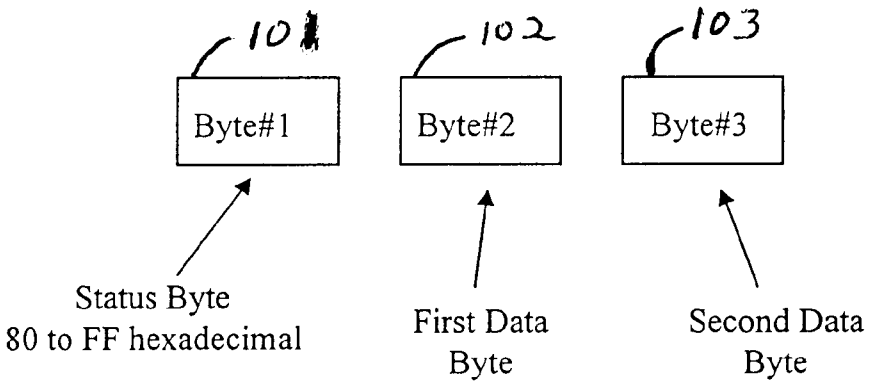
FIG. 3 illustrates a typical data format for real time transmission of a MIDI instrumental music command over cable in a studio environment.
Figure 4:
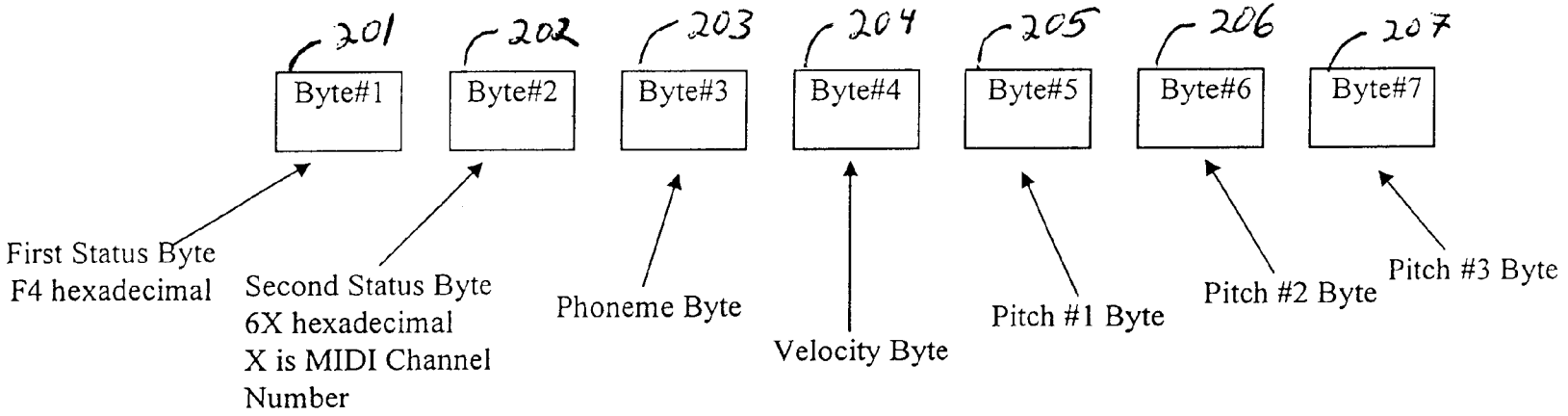
FIG. 4 illustrates a typical data format for real time transmission of a MIDI vocal "note-on" command over cable in a studio environment.
Figure 5:
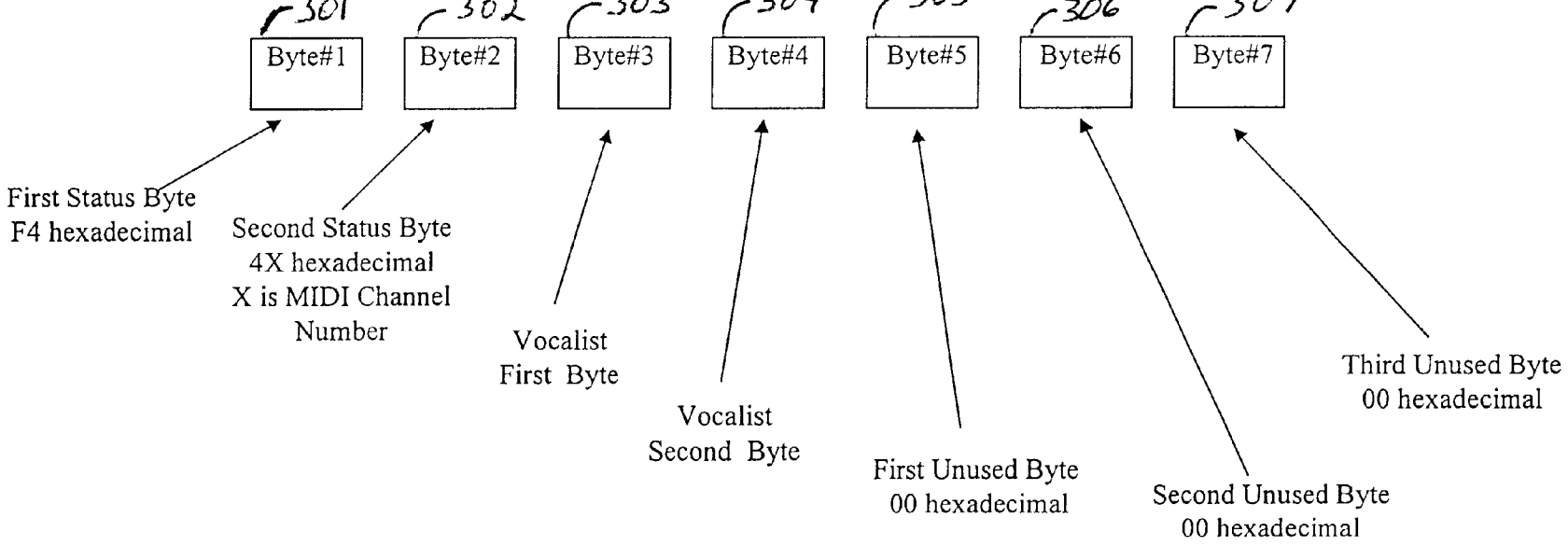
FIG. 5 illustrates a typical data format for real time transmission of a MIDI vocal program change command over cable in a studio environment.
Figure 6:
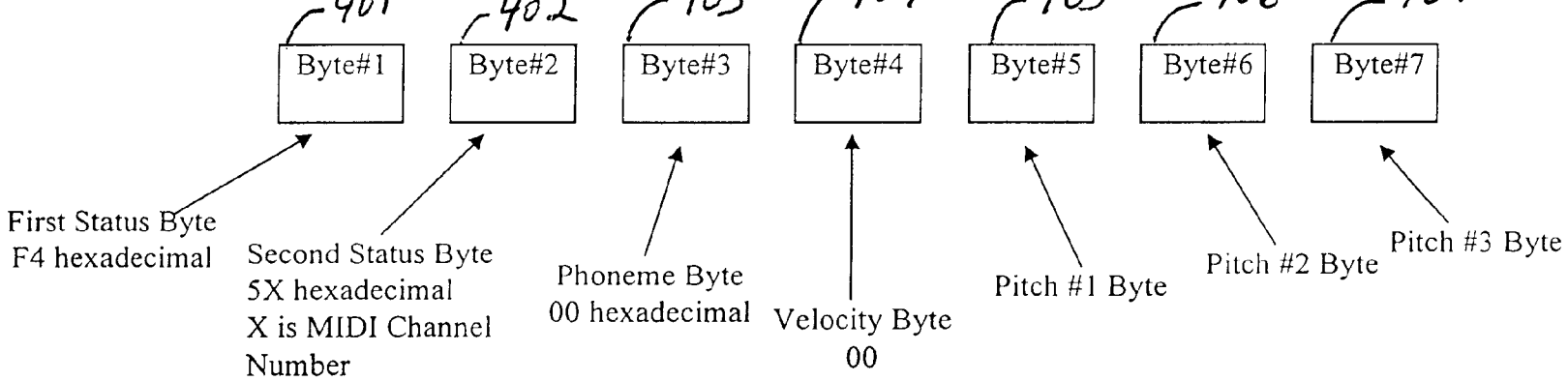
FIG. 6 illustrates a typical data format for real time transmission of a MIDI vocal "note-off" command over cable in a studio environment.

FIG. 2 illustrates standard MIDI data. For each status byte with a given hexadecimal value, a given command function is performed. Each command function itself requires an additional one or two data bytes to fully define that command function, except for the system control command function which may require any number of additional data bytes. FIG. 3 illustrates a typical three byte MIDI instrumental command in block form. The command contains one status byte 101, first data byte 102 and second data byte 103. FIGS. 4, 5 and 6 illustrate typical seven byte MIDI vocal commands as devised for this invention. FIG. 4 illustrates a MIDI vocal "note-on" command; this command contains first status byte 201, second status byte 202, phoneme byte 203, velocity byte 204, pitch#1 byte 205, pitch#2 byte 206, and pitch#3 byte 207. The velocity byte specifies the loudness of the sound. FIG. 5 illustrates a MIDI vocal program change command; this command contains first status byte 301, second status byte 302, vocalist first byte 303, vocalist second byte 304, first unused byte 305, second unused byte 306 and third unused byte 307. Within the MIDI vocal program change command, the unused bytes may be utilized to convey data describing additional characteristics of the vocalist, such as emotional state, which the sound generator can use to modify the sounds produced. The term vocalist includes both singers and speakers. FIG. 6 illustrates a MIDI vocal "note-off" command; this command contains first status byte 401, second status byte 402, phoneme byte 403, velocity byte 404, pitch# 1 byte 405, pitch#2 byte 406, and pitch#3 byte 407. As with MIDI instrumental commands, MIDI vocal command functions will be determined by the hexadecimal value of the status bytes. But MIDI vocal commands will each have two status bytes, first status byte and second status byte, compared with only one status byte for MIDI instrumental commands. MIDI vocal "note-on" and "note-off" commands are used for both singers and speakers. Other differing data formats may be used, each with different quantities of data, provided that they convey the same types of information for the control and operation of sound generators. The phoneme byte 203 specifies the elementary speech sound information for use by the receiver's internal sound generator. The preferred embodiment utilizes elementary speech sounds as defined by the International Phonetic Alphabet; however other elementary speech sounds may be used. This invention also uses the MIDI data to encode for sounds that may not traditionally be considered human vocal sounds nor instrumental sounds. Some examples of such sounds are animal sounds, machinery sounds, sounds occurring in nature, a hand knocking on a door, the sound of a book hitting the floor, and the sound of fingernails scratching across a blackboard.

Figure 7:
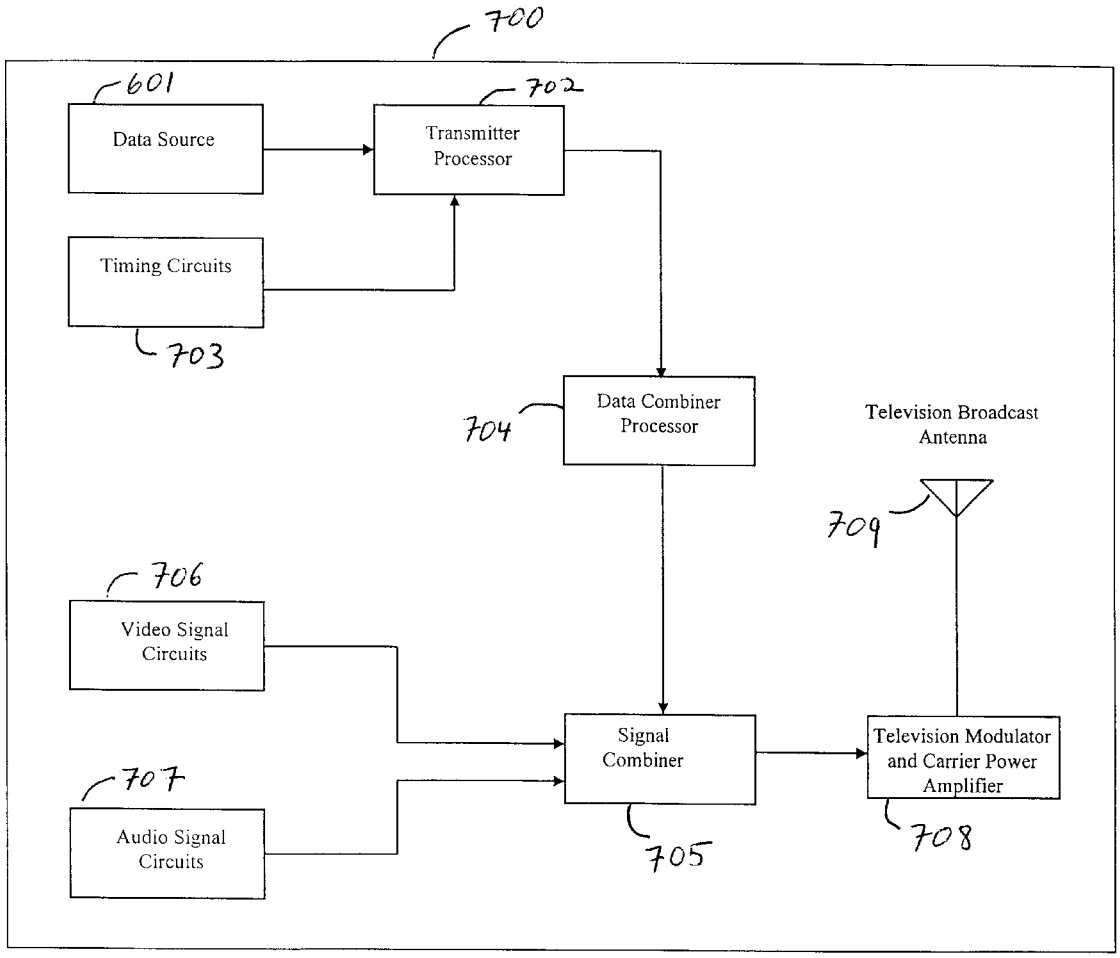
FIG. 7 is a block diagram of a television broadcast transmitter system which includes a MIDI data source.

FIG. 7 illustrates a television broadcast transmitter system 700 with data source. The data source 601 outputs MIDI data. Two examples of devices which can be a data source 601 are personal computer using proprietary software or well-known commercial software such as Cubase or Cakewalk products (the latter presently produce standard MIDI data), and a MIDI data sequencer which stores previously created MIDI data. The data source 601 may also output MIDI data real-time from transducers connected to acoustic music instruments, digital MIDI data outputs from electronic music instruments, signal processors which convert analogue or digital sound waveforms into MIDI data and from data entry into keyboards or other data entry devices.

FIG. 8 illustrates typical television MIDI data outputted by the data source 601 functionally grouped into data paths or data streams. The data source can output large amounts of MIDI data representing the instrumental music sound track of the current television program and language translations of the vocal music and speech for that program. In addition and concurrently, the data source can output the instrumental music sound track of an auxiliary or unrelated music program and vocal music and speech for that auxiliary program.

For NTSC television the conventional non-MIDI program soundtrack and vocals of the program are produced by Audio Signal Circuits 707 and sent via conventional program sound transmission using a frequency modulated subcarrier and are processed at the receiver in conventional circuits. For all-digital television, the conventional non-MIDI program soundtrack and vocals are sent via conventional program sound transmission using digital data signals and are processed at the receiver in conventional circuits.

Referring back to FIG. 7, the MIDI data for each data path is routed from the data source 601 to the transmitter processor 702. Now in a television broadcast transmitter system 700, because of the inability to transmit the MIDI data in real time, the MIDI data for each data path from the data source must be divided into time segments and placed into packets by the transmitter processor 702. The time segments are called accumulator periods. In this preferred embodiment, the duration of an accumulator period is 64 NTSC picture fields where there are approximately 60 picture fields each second or, for digital television, the duration is 32 digital television pictures, where there are 30 pictures each second. Other values of duration may be implemented. The transmitter processor 702 also receives timing signals from the timing circuits 703. Timing signals provide time references. The transmitter processor divides the MIDI data for each data path into accumulator periods. The transmitter processor then creates a time tag byte representing the relative time, within an accumulator period, at which each MIDI command was received from the data source and appends each MIDI command with its respective time tag byte. As described below, a receiver uses the time tag byte for timing corrections of the MIDI data. Each MIDI instrumental command, at this point in time, contains four bytes of data. Each MIDI vocal command, at this point in time, contains eight bytes of data. While it is possible that the time tag may contain greater than one byte of data, in the preferred embodiment the time tag contains one byte of data.

The transmitter processor 702 applies time tag bytes to all MIDI commands within each data path and temporarily stores all MIDI data until the end of each accumulator period. An accumulator period contains 64 data fields for each data path. The quantity of instrumental and vocal commands is limited so as to occupy only 44 data fields out of the 64 data fields in order to provide capacity for packet header data and error detection and correction data. A typical MIDI instrumental command occupies one data field, and each MIDI vocal command typically occupies two data fields. In this preferred embodiment, there are a maximum quantity of 44 instrumental commands or 22 vocal commands within an accumulator period for each data path. Other differing data formats may be implemented which utilize different lengths of time for the accumulator period, different quantities of data fields within an accumulator period, and different quantities of instrumental commands and vocal commands within each data field and accumulator period. In alternative embodiments, the lengths of time for the accumulator periods may vary within a signal, provided that data is included which specifies the length of each accumulator period, thereby facilitating timing correction at a receiver.

It should be noted that in the preferred embodiment, error detection data and error correction data are included in an accumulator period. In an alternative embodiment, error correction data could be omitted.

At the end of an accumulator period, the MIDI data processed during that accumulator period is sent to the data combiner processor 704. The data combiner processor produces packet header data, burst error detection and correction data, and random error detection and correction data. To the 44 instrumental commands or 22 vocal commands of each accumulator period and data path, the data combiner processor adds one packet header field and burst error detection and correction data for a total of 64 data fields. These 64 data fields for each data path are one packet. It is possible for one packet to contain a different number of data fields, but 64 data fields per packet is the preferred embodiment. The data combiner processor 704 may also add random error detection and correction data to each of the 64 data fields. If, for any reason, the MIDI data of a particular accumulator period is placed in two or more packets for transmission, then each of those packets will contain information identifying the accumulator period to which the MIDI data belongs. One example of this identifying information is a data byte within the packet header field which contains a simple serial number for each accumulator period. The value of the serial number may simple increment by one count for each successive accumulator period and reset when a maximum count has been attained.

Figure 9:
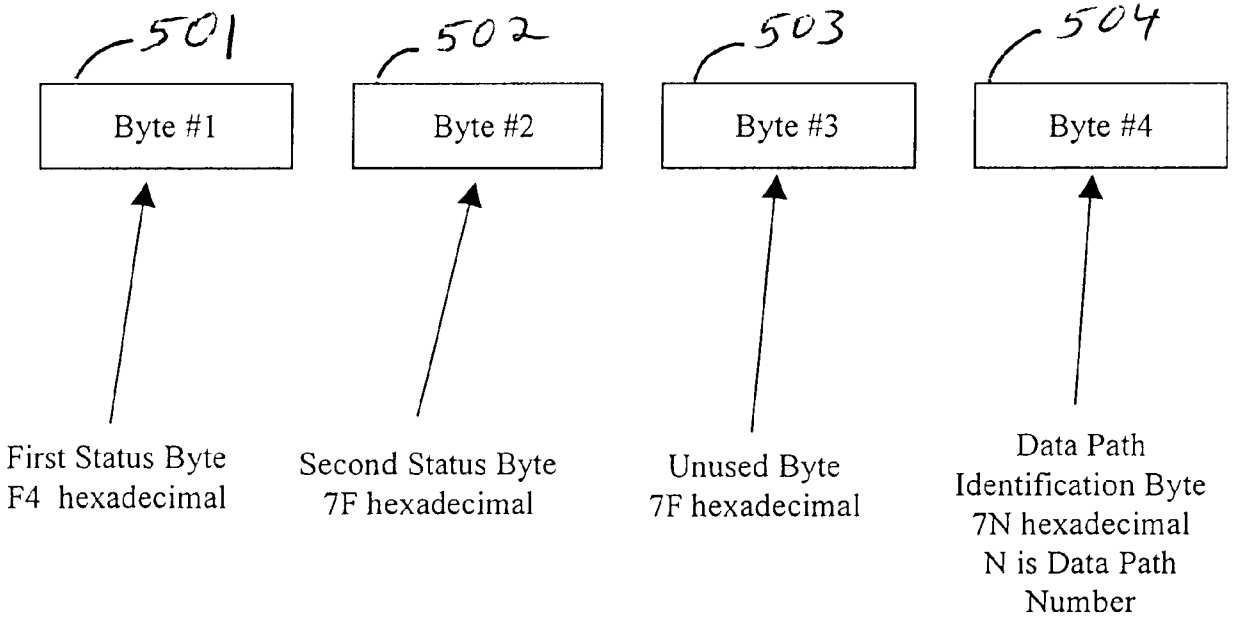
FIG. 9 illustrates a typical packet header field format for use with MIDI data.

It is necessary to provide a packet header field at the start of each accumulator period for each data path in order to identify each data path and identify their starting point; thereby facilitating the processing of MIDI data at a receiver. FIG. 9 illustrates a packet header field. A packet header field contains first status byte 501, second status byte 502, unused byte 503, and data path identification byte 504. The packet header field allows a receiver to recognize the 64 data fields belonging to each accumulator period for each data path. For NTSC television, each data path may also be identified by the three specific picture lines on which they are conveyed. For digital television, each data path is identified by the packet header field.

The values of the burst error detection and correction data for each packet will depend upon the error detection and correction method implemented. Various error detection and correction methods are well known in the art-field.

The value of the random error detection and correction data within each field will depend upon the error detection and correction method implemented. Various error detection and correction methods are well known in the art-field.

Because vocal commands each require two data fields, it is necessary to provide a method of reducing the vocal data quantity in order to not exceed the maximum data rates within a data path. This reduction is accomplished within the data source 601 at the transmitter by eliminating all vocal "note-off" commands (on a data path and MIDI channel) which are immediately followed by another "note-on" command. It is reasonable to eliminate these vocal "note-off" commands because a vocalist can only sing or speak one phoneme at a time. The receiver adds the vocal "note-off" commands back into the MIDI data during processing.

Referring back to FIG. 7, the packets are sent from the data combiner processor 704 to the signal combiner 705. The video and audio signals are sent also to the signal combiner 705 from the video signal circuits 706 and audio signal circuits 707, respectively. The video signal circuits 706 produce the picture information. The audio signal circuits 707 produce the conventional program soundtrack and vocals. Within the signal combiner 705, the packets from the data combiner processor 704 are combined with the video and audio signals using techniques which are well known in the art-field for both NTSC and digital television broadcasting systems. In the preferred embodiment, the MIDI data is conveyed in a format which utilizes the closed captioning data detectors within television receivers. However, it is possible to convey the MIDI data in other formats.

The combined MIDI data, video signals, and audio signals are then passed to the television modulator and carrier power amplifier 708, and then is sent to the television broadcast antenna 709 for broadcasting. It is also understood that within the television broadcast transmitter system 700, other non-MIDI data such as closed captioning may also be produced and combined at the signal combiner 705 and then conveyed within the broadcast television signal. This embodiment indicates that the audio signals, video signals, non-MIDI data and MIDI data are generated, processed and combined in various steps, but it is possible that the signals and data are generated and processed in parallel and combined together in one piece of equipment or that the signals and data are generated and processed serially and combined.

Figure 10:
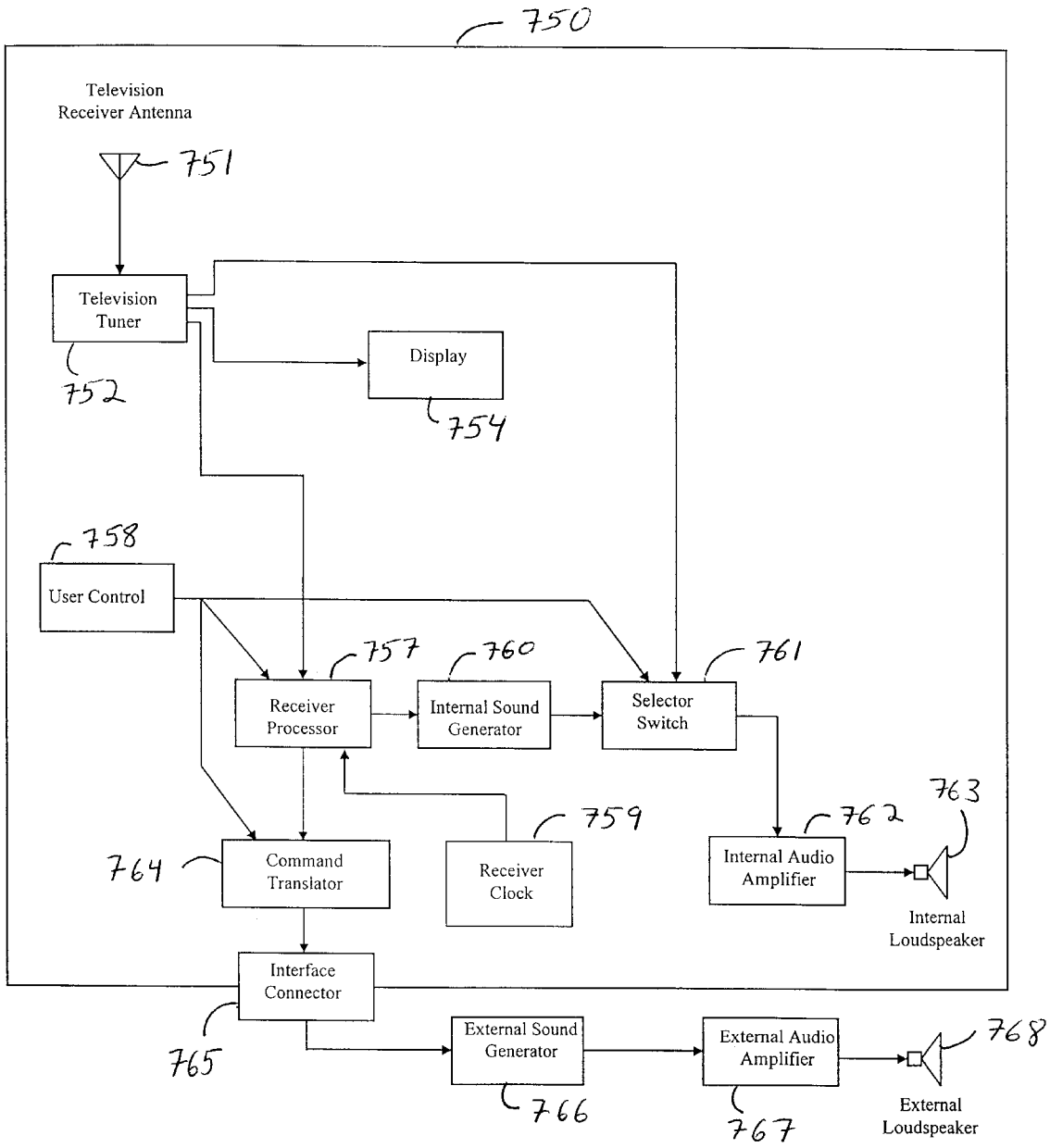
FIG. 10 is a block diagram of a television receiver which includes a MIDI sound generator.

FIG. 10 is a block diagram of a television receiver 750 with a sound generator. In FIG. 10, a television receiver antenna 751 receives the broadcast signal and passes the signal to a television tuner 752 which receives the signal and detects the video signal, the audio signal, and the MIDI data signals. The video signal is sent to the display 754 for viewing. The audio signal which contains the conventional program soundtrack and vocals is sent to selector switch 761. The MIDI data signals are sent to the receiver processor 757. The receiver clock 759 produces timing signals which are sent to the receiver processor 757 for a time reference.

The receiver processor 757 performs several functions on the MIDI data while keeping separate the MIDI data of the various data paths. While it is not necessary for the receiver processor to perform all of the functions described herein, these functions are the preferred embodiment. It is obvious to one skilled in the art that some functions may be omitted altogether or performed by other components without departing from the scope and spirit of this invention.

The receiver processor 757 first utilizes the random error detection and correction data within each data field to detect and correct, within that field, random bit errors which may have occurred during transmission. Next, the packet header fields, for each data path, are utilized by the receiver processor to separate the MIDI data of each data path into packets or accumulator periods, each with 64 data fields for subsequent processing. Then the receiver processor utilizes the burst error detection and correction data within each data path packet to detect and correct any burst errors in the MIDI data within the accumulator periods being processed. The receiver processor 757 next inspects the time tag byte of each vocal and instrumental command and places the commands at the correct relative time position within the accumulator periods. To accomplish this correct relative time position placement, the commands may each be appended with a receiver time tag data word based upon the timing signals from the receiver clock 759. The receiver time tag data word will specify the time at which each command will be output from the receiver processor 757. Alternately, the receiver time tag data word may specify the time duration between each command as with typical MIDI sequencer devices.

The receiver processor 757 also recreates the vocal "note-off" commands deleted by the transmitter data source 601. This recreation is accomplished as follows: The receiver processor, upon receipt of a vocal "note-on" command for a particular data path and MIDI channel, will automatically issue a "note-off" command for any previous notes sounding on that data path and/or channel prior to issuing the vocal "note-on" command.

The user control 758 interfaces with the receiver processor 757, command translator 764, and selector switch 761. The user control provides a user with the ability to change certain operating features within the receiver. These operating features are described later. The user control may include a visual display or use the receiver display 754 for providing instructions and information to the user.

The receiver processor 757 also performs two data error compensation functions to aid in preventing malfunction of internal sound generator 760 and the external sound generator 766 whenever all data errors are not corrected by the random error correction data and burst error correction data.

The first data error compensation function which prevents note ciphering is performed by anti-cipher logic within the receiver processor 757. This function may be activated and deactivated by the user using the user control 758. Furthermore, the anti-cipher logic's various modes of operation may be selected by the user using the user control. Ciphering is an archaic term referring to the unintentional sounding of an organ pipe, due in most cases to a defective air valve which supplies air to the pipe. Ciphering of notes in this invention or any MIDI based or similar system is also a very real possibility because of bit errors in data which could cause one of several possible problems. The following are examples for MIDI instrumental commands; the same concepts apply to MIDI vocal commands.

The first possible problem is a "note-off" command with a bit error. Referring to FIGS. 2 and 3, if the status byte 101 is in error, then the command will be unrecognized by the sound generator and the corresponding note will cipher. If the first data byte (note number or pitch) 102 is in error, then the processor will attempt to turn off the wrong note and the intended note will cipher.

The second possible problem is a "note-on" command with a bit error. If the statue byte 101 is in error, then the command will be lost and ciphering will not occur. If, however, the first data byte (note number or pitch) 102 is in error, the wrong note will sound. Sounding the wrong note is a problem, but the more serious problem occurs whenever the corresponding "note-off" command attempts to turn off the correct note and the wrong note remains on (ciphering).

The third possible problem occurs whenever a "note-on" with zero velocity is substituted for a "note-off" command. In this case, there can be ciphering problems if there is a bit error in the second data byte (velocity) 103 and the value is not zero. Of course there will also be problems if the status byte 101 or the first data byte 102 are in error.

To combat the potential problems of ciphering because of data errors, the anti-ciphering logic will, in general, issue "note-off" commands as required to any note which has been sounding for a period of time exceeding the anti-ciphering logic time delay. In general, each MIDI channel will be assigned an anti-ciphering logic time delay differing from the other MIDI channels.

There are several different methods for the receiver to determine the anti-ciphering logic time delays. One method is for the anti-ciphering logic time delays for each MIDI channel to be specified by special system commands from the data source 601. These special system commands can be devised for each MIDI channel and will specify anti-ciphering logic time delays for use by the receiver processor 757. A second method is for the user to manually set the anti-ciphering logic time delays via a user control 758. This user control can be on a remote control unit or on a front panel control or any other type of unit with which a person can interface and input data. A third method is to have the receiver processor 757 determine the anti-cipher logic time delays by analyzing the bit error rate. The bit error rate is the quantity of bit errors detected over a period of time and provides a measure of the condition of the signal. The bit error rate can be calculated by the receiver processor while performing the random error and burst error detection and correction procedures. Other measures of the quality of reception and thus the quality of the MIDI data received, such as quantity of bit errors in accumulator periods or a running average of number of bit errors, may be used. It is also possible to measure the byte error rate or another unit. In general, any technique of quantifying data error rate may be useful in providing a measure of the condition of the signal and thus quality of reception. The bit error rate is a preferred measure for data error rate. The receiver processor can reduce the anti-ciphering logic time delays as the bit error rate increases.

The fourth method for the receiver to determine the anti-ciphering logic time delays is based upon two parameters, the average note length and bit error rate. The receiver processor 757 automatically controls the anti-ciphering logic time delays for each MIDI channel by computing the average note lengths and the bit error rates. To calculate the anti-ciphering logic time delays, the receiver processor first computes for each MIDI channel the average duration of the notes for which there were correctly received "note-on" and "note-off" commands. Then this average duration is multiplied or otherwise conditioned by a factor based upon the bit error rate or number of bit errors in that same accumulator period or based upon a running average number of bit errors. The factor will generally be reduced as the bit error rate increases. Use of this fourth method will occasionally result in cutting off some notes early, prior to receipt of the note's broadcast "note-off" command.

An optional feature for the prior methods is for the receiver processor to analyze the average note lengths for two or more ranges of notes within each MIDI channel and assign anti-ciphering logic time delays to each range. For example, one range can be from middle C upward and one range can be below middle C.

In the preferred embodiment, the anti-cipher time delays will be generated by a combination of the fourth method and the first method along with the optional feature.

In general the ciphering problem for MIDI voice data is similar to the ciphering problem for MIDI instrumental music data. While the solution is similar, there are some specific differences which require a more sophisticated approach for the MIDI voice data problem.

Ciphering is inherently minimized for vocal music because the receiver processor 757 automatically turns off all previous vocal notes whenever a subsequent vocal "note-on" command is received for the same MIDI channel. This scheme was devised in order to achieve the high peak values of phonemes per second required for some music.

Because "note-off" commands for MIDI vocal data may not be sent except in cases where a note is not immediately followed by another, it will not be possible to measure average note length for vocal sounds at a receiver based upon received "note-on" to "note-off" duration. In general, for vocals, average note length will be measured, at the receiver, based upon received "note-on" to "note-on" duration where "note-off" commands have been deleted, or not yet added back. This measurement will only be reliable, however, during periods of good reception whenever the bit error rate is low.

It is also important to consider that consonant phonemes are short while vowel phonemes may be long or short but are generally longer than consonant phonemes. Because of this difference in phoneme duration, the receiver processor 757 may implement different anti-ciphering logic time delays for consonants and vowel phonemes and inject vocal "note-off" commands for consonants and vowels whenever a sound exceeds its computed anti-cipher logic time delay. In the preferred embodiment the average note length is used to determine the time delays. In alternative embodiments, other measures of note length may be used. Two examples of these other measures are maximum note length and median note length.

The receiver processor 757 also contains the anti-command logic which performs the second data error compensation function. The function may be activated and deactivated and otherwise controlled by the user using the user control 758. The anti-command logic also utilizes the condition of the signal, based upon the bit error rate of the data, for making decisions as did the anti-cipher logic.

Anti-command logic permits the receiver processor to selectively output only high priority commands during periods of poor reception. Poor reception is defined as that period of time when the bit error rate exceeds a pre-determined value, the poor reception value. Two examples of high priority commands are "note-on" and "note-off" commands; other commands may also be considered high priority commands. During periods of moderate reception, the anti-command logic within the receiver processor selectively outputs moderate and high priority commands but inhibits passage of low priority commands which could significantly degrade the music program. Moderate reception is defined as that period of time when the bit error rate is less than the poor reception value but higher than a good reception value which is a second, pre-determined value. The low priority commands, of which the receiver processor inhibits passage, may include, but are not limited to, program change commands. Moderate priority commands, of which the receiver processor outputs during periods of moderate reception, may include, but are not limited to, control change commands. High priority commands, of which the receiver processor outputs during moderate reception, include "note-on" and "note-off" commands, as previously described; other commands may also be considered high priority commands.

During periods of poor and moderate reception, the receiver processor 757 may also, for example, automatically issue default program change commands and control change commands after several seconds delay to replace those program change commands and control change commands which are inhibited and thereby ensuring adequate control of the sound generator. When the anti-command logic is implemented within the receiver, then the data source 601 must output periodic updates of program change commands and control change commands every few seconds in order to provide correct MIDI data as soon as possible whenever the signal reception improves. During periods of good reception, whenever the bit error rate is less than the good reception value, the receiver processor 757 outputs various control change commands and program change commands in a normal manner. The actual number for the good reception value and poor reception value may vary depending on a number of factors.

The receiver processor 757 also performs two editing functions upon the vocal commands. The first editing function is monitoring the phoneme sequences of the incoming vocal "note-on" commands and recognizing specific words or phoneme sequences. The receiver processor deletes the words or substitutes other words for the recognized specific words or phoneme sequences. Deletion can occur by inhibiting the output of the MIDI data for the recognized phoneme sequences. In such a manner, the internal sound generator 760 or external sound generator 766 is prevented from sounding the recognized specific words or the words represented by phoneme sequences. Deletion can also occur by changing the MIDI data encoding for velocity to zero or nearly zero for the recognized phoneme sequences. In such a manner, the internal sound generator 760 or external sound generator 766 creates the phoneme sequences but the volume is so low, one can not hear it. This first editing function can be controlled by the user control 758. The user control can activate and deactivate this function and alter the specific words and phoneme sequences to be edited. The purpose of this first editing function is to prevent selected words, deemed to be offensive by the user, from being sounded by the internal sound generator or external sound generator or, if sounded, produced at a level which can not be heard. The receiver processor will normally need to delay the throughput of MIDI data by at least one additional accumulator period in order to process complete words whose transmission spans two or more accumulator periods. Word substitution can occur by substituting MIDI data encoding for another phoneme sequence for the MIDI data of the recognized phoneme sequence. The substituted MIDI data will be placed within the time interval occupied by the phoneme sequence which is to be removed.

The second editing function to be performed upon vocal commands by the receiver processor 757 is that of selectively adjusting the loudness level of specific phonemes, typically consonants, for enhanced word clarity for both speech and vocal lyrics. This second editing function is controlled by the user control 758. When activated, this second editing function increases the loudness level of consonant phonemes or other specified phoneme sequences deemed critical for speech clarity by those skilled in speech science or by the user. In addition, the second editing function also permits the user, by using the user control to selectively adjust the relative loudness of the data paths and MIDI channels in order to increase or decrease the relative loudness of the vocal signals. These features are beneficial to persons with hearing impairments. To adjust the loudness level, the receiver processor changes the MIDI data encoding for the velocity of the selected phonemes, for the velocity of data within one or more channels, and/or for the velocity of data within one or more data paths.

After the MIDI data is processed, it is temporarily stored within the receiver processor 757 until the correct time arrives, based upon the time tag bytes and the receiver time tag data words, for sending out each of the various commands to the internal sound generator 760 and command translator 764. Prior to outputting the commands the receiver processor removes all random error detection and correction data, burst error detection and correction data, packet header fields, time tag bytes and receiver time tag data words.

Referring to FIG. 8 and FIG. 10, because normally eight data paths will be available for television transmission, the user control 758 enables the user to select the desired program related music and language from the program related MIDI data paths 52 or enables the user to select auxiliary soundtracks independent of the current program in a desired language from the auxiliary MIDI data paths 53. The user control interacts with to the receiver processor 757 and thereby instructs the receiver processor to pass the selected data paths and/or MIDI channels to the internal sound generator 760. The user control may also instruct the receiver processor to output the same or other selected data paths and/or MIDI channels to the command translator 764.

FIG. 8 illustrates the MIDI sound generator channels to which the various data paths have been assigned. Where more than one data path is assigned to a particular MIDI channel, only one of those data paths will be selected at any particular time by the user control for sending data to the internal sound generator or to the command translator. Therefore, no conflicts in MIDI channel usage should arise.

FIG. 3 illustrates a typical MIDI instrumental command, and FIGS. 4, 5 and 6 illustrate typical MIDI vocal commands sent to the internal sound generator 760. If the internal sound generator 760 is designed to utilize a data format different from that of the broadcast data format, then the receiver processor 757 must reformat the data appropriately.

The internal sound generator 760 creates the instrumental and vocal sounds in response to the "note-on" and "note-off" commands from the receiver processor 757. The internal sound generator may utilize any available technique, such as sampled waveforms and/or synthesis techniques, for creating the various sounds. These sounds will be output from the internal sound generator in the form of audio signals.

An internal sound generator 760 which uses sampled waveform has stored digitized waveforms to create each sound. For vocal sounds, each sampled waveform is a digital recording of one phoneme sound at a particular pitch. The vocal sampled waveforms may be obtained from actual recordings of a person's speech and vocal music. Within the MIDI vocal program change command, the unused bytes may be utilized to convey data describing additional characteristics of the vocalist, such as emotional state. The sound generator can use the data to modify the phoneme sounds produced. Referring to FIG. 4, the internal sound generator utilizes the phoneme byte 203, pitch #1 byte 205, pitch #2 byte 206, and pitch #3 byte 207 of a vocal "note-on"

command in conjunction with the voice, as determined by the most recent vocal program change command (see FIG. 5) to select from memory the stored digital recordings corresponding to the phoneme and the pitch or pitches to be sounded. In the preferred embodiment the sound generator stores data for each phoneme sound at each pitch. In an alternative embodiment, the sound generator stores data for phoneme sounds at one or more pitches and derives sounds for other pitches using techniques known in the art field. Note that normally only one pitch will be used for a solo vocalist and up to three pitches may be used for choral ensembles. The internal sound generator 760 converts the digital recording or recordings into audio signals. In addition, the internal sound generator utilizes the velocity byte 204 to adjust the loudness of the phoneme sound. The second status byte 202 assigns the vocal phoneme sound to a specific MIDI channel. Referring to FIG. 5, the voice for a MIDI channel is determined by both the vocalist first byte 303 and vocalist second byte 304 of the most recent vocal program change command for that channel. The second status byte 302 assigns the voice to a specific MIDI channel. The voice for a channel may be changed at any time by a new program change command to that channel.

An internal sound generator 760 using sampled waveforms utilizes techniques well-known in the art-field to create instrumental music in response to "note-on" and "note-off" commands.

An alternative approach of generating sound is for the internal sound generator 760 to utilize synthesizer techniques. It is well known in the art-field how a synthesizer generates vocal sounds. Referring to FIG. 4, the internal sound generator will utilize the phoneme byte 203 and pitch # 1 byte 205, pitch #2 byte 206, and pitch #3 byte 207 of a vocal "note-on" command in conjunction with the voice as determined by the most recent vocal program change command (see FIG. 5) to select from memory the stored synthesizer parameters for the required vocal sounds. These parameters will set oscillators, filter bandpass frequencies, and amplitude modulators of the synthesizers which produce one or more audio signals. In the preferred embodiment the sound generator stores data for creating each phoneme sound at each pitch. In an alternative embodiment, the sound generator stores synthesizer parameters for phoneme sounds at one or more pitches and derives sounds for other pitches using techniques known in the art field. In another embodiment, the synthesizer creates vocal sounds by modeling the anatomy of the human vocal mechanism. In addition, the velocity byte 204 adjusts the loudness and the second status byte 202 assigns the vocal phoneme sound to a specific MIDI channel. The singer or speaker's voice, for a MIDI channel, is determined by the most recent vocal program change command for that channel.

An internal sound generator 760 that uses synthesized waveforms, utilizes techniques well-known in the art-field to create instrumental music in response to "note-on" and "note-off" commands.

Use of an internal sound generator that is a synthesizer has a significant advantage over one that uses stored digitized waveforms. Digitized waveforms require many samples of each waveform with each sample normally requiring two or more bytes of data. With a synthesizer, the internal sound generator may store only synthesizer parameters for setting oscillators, filter bandpass frequencies and filter amplitude modulators. Thus, the synthesizer technique should require significantly less memory than the sampled waveform technique of producing sounds. However, either technique of producing sounds is possible with this invention.

Whenever the receiver is initially turned on or tuned to a television channel with an on-going MIDI song or speech, the internal sound generator 760 will need an input of certain MIDI commands in order to be properly initialized. The two most important MIDI commands are program change commands which selects the voices for each of the sixteen MIDI channels and control change commands which activates features such as sustain, tremolo, etc. Thus, in order to ensure correct operation of the internal sound generator, the data source 601 at the transmitter should continuously update and output program change commands and control change commands as often as practicable. In addition, the receiver processor 757 can be designed to silence the internal sound generator and external sound generator until the receiver processor receives an adequate amount of program change command data and control change command data. Alternatively, the receiver processor may be designed to output to the internal sound generator and external sound generator default values of program change commands and control change commands until updated values are received from the transmitter.

Audio signals from the internal sound generator 760 are sent to the selector switch 761. The user, operating the user control 758, can operate the selector switch and thus select either the conventional non-MIDI audio signals from the television tuner 752, or the audio signals from the internal sound generator. The internal sound generator, depending upon user selections described previously, may output a second or third language of the current program or an auxiliary sound track also with some language of choice. The signal chosen will be routed to the internal audio amplifier 762 and internal loudspeaker 763 for listening by the user.

Referring to FIG. 10, a receiver may also contain a command translator 764 and an interface connector 765. The receiver processor 757 may be instructed by the user control 758 to pass selected data paths and/or channels to the command translator. The user control interacts with, activates, and controls the features of the command translator. Whenever the features of the command translator are inactive, all MIDI commands are passed unchanged through the command translator to the interface connector 765. When activated, the command translator converts the MIDI commands into a form which is compatible with an external sound generator 766 which requires a MIDI command format differing from that which is output from the receiver processor. In addition, if the external sound generator does not have vocal music capabilities, the command translator can convert the vocal commands into standard MIDI instrumental commands. Thus the command translator and interface connector pass MIDI data from the receiver processor to an external sound generator. The external sound generator operates in the same manner as the internal sound generator 760 described previously, except when the external sound generator does not have vocal music capabilities. Also note that the external sound generator may, in some cases, be built into a MIDI portable keyboard. The external sound generator outputs audio signals to an external audio amplifier 767 and external loudspeaker 768.

It is understood that within the television receiver 750 that other, non-MIDI data may be present within the received data signals. This other, non-MIDI data may also be detected by the television tuner 752 and then passed to the respective processors.

In this preferred embodiment, the audio signals, video signals, MIDI data and non-MIDI data are processed and outputted in various steps, but it is possible that the signals and data are processed in parallel and outputted in one piece of equipment or that the signals and data are processed serially and outputted. It is also possible that the receiver processes the MIDI data in various pieces of components.

Figure 11:
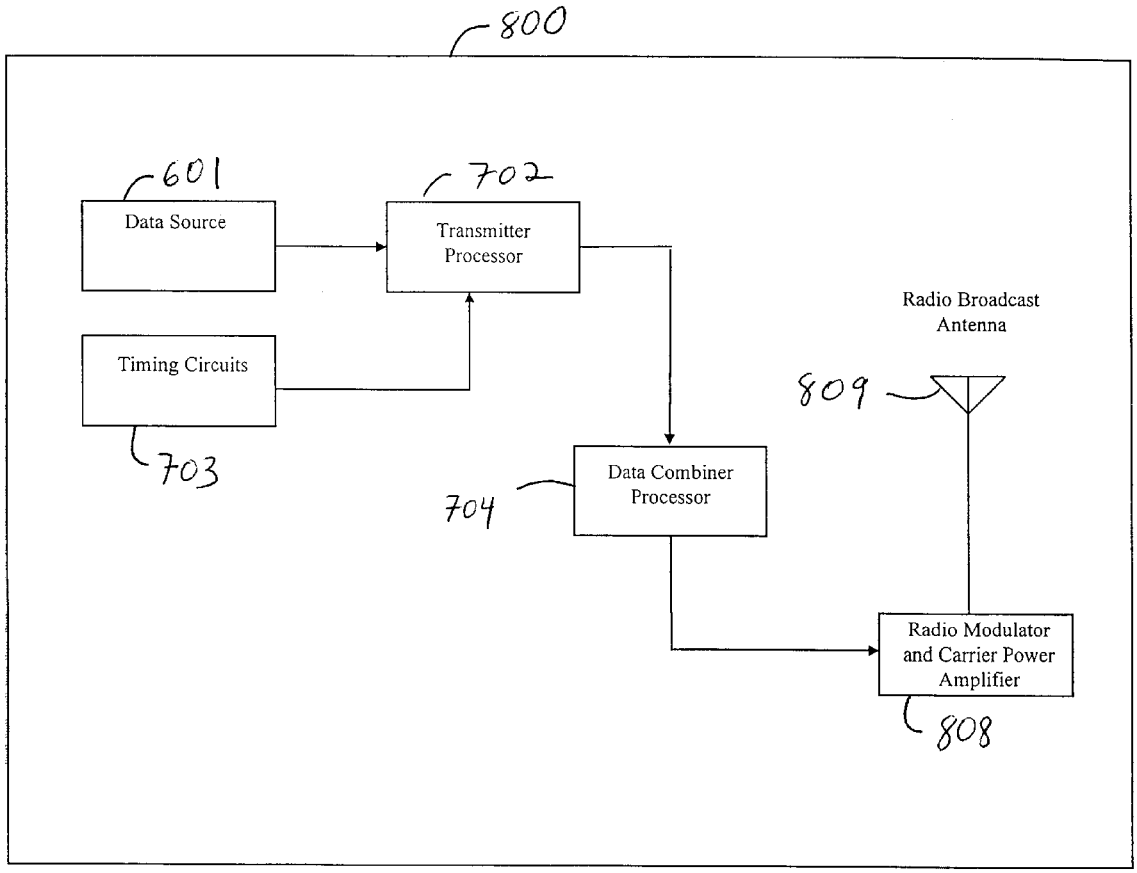
FIG. 11 is a block diagram of a radio broadcast transmitter system which includes a MIDI data source.

FIG. 11 illustrates a radio broadcast transmitter system 800 with a data source, 601. Instrumental music, vocal music, language translations of the vocal music, speech dialog from a program, language translations of the dialog from a program, and/or a combination of these items are output by the data source. The data source like that for television (see FIG. 7), may be a device which outputs MIDI data. Some examples of a data source, 601, are a computer, a device which stores previously created MIDI data, a MIDI sequencer device, or any other device which outputs MIDI data. Other examples of a data source 601 are devices that output MIDI data real-time, such as transducers connected to acoustic music instruments, digital data outputs from electronic music instruments, signal processors which convert analogue or digital sound waveforms into MIDI data, and from data entry into keyboards. The MIDI data output from the data source 601 is sent to the transmitter processor 702 which divides the data into accumulator periods and applies time tag bytes in the same manner as the television system (see FIG. 7).

Timing circuits 703 sends timing signals to the transmitter processor 702 to provide time references. Packet header fields are added to the data packets by the data combiner processor 704 which is downstream from the transmitter processor. The data combiner processor also adds burst error detection and correction data and random error detection and correction data to each packet. The MIDI data is then passed to a radio modulator and carrier power amplifier 808, then to a radio broadcast antenna 809.

Figure 12:
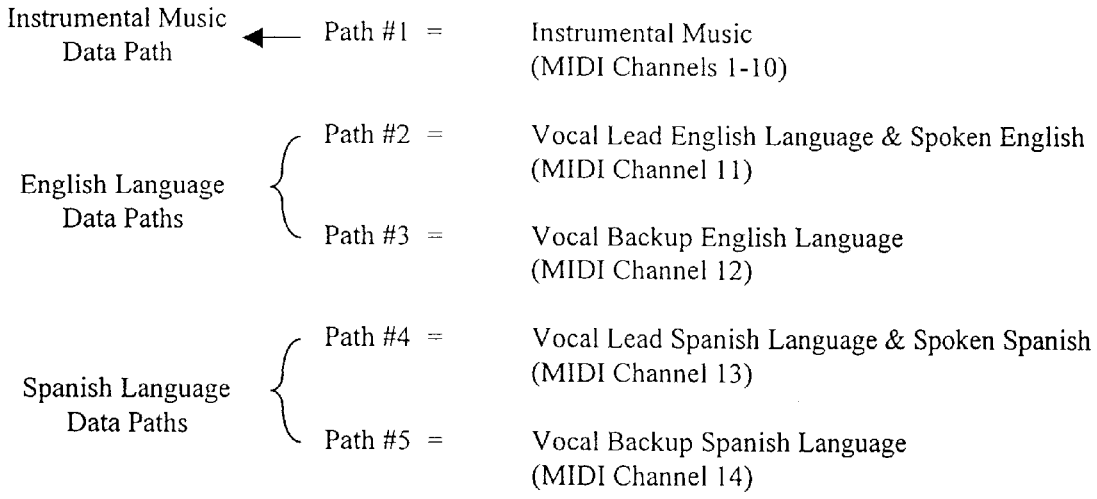
FIG. 12 is a chart showing the functional assignments for five MIDI data paths within a radio broadcast signal.

The MIDI data for radio broadcasting is conveyed in a format similar to the MIDI data for television broadcasting. The MIDI data for radio, however, will normally be sent continuously because it is not required to share the radio channel with a picture signal as with television. For radio, the MIDI data is grouped into data paths or data streams. Radio however will normally have five data paths (see FIG. 12). In the preferred embodiment, each packet for each radio data path contains 64 data fields, as described for television above, and contains MIDI data accumulated over a duration of 64/60 seconds or approximately 1.07 seconds. Other values may, however, be used. In the preferred embodiment, each packet of radio MIDI data contains one packet header field, 44 data fields containing MIDI instrumental and vocal commands, and burst error detection and correction data equivalent to 19 data fields. Recall that 44 data fields can carry 44 instrumental commands or 22 vocal commands.

Figure 13:
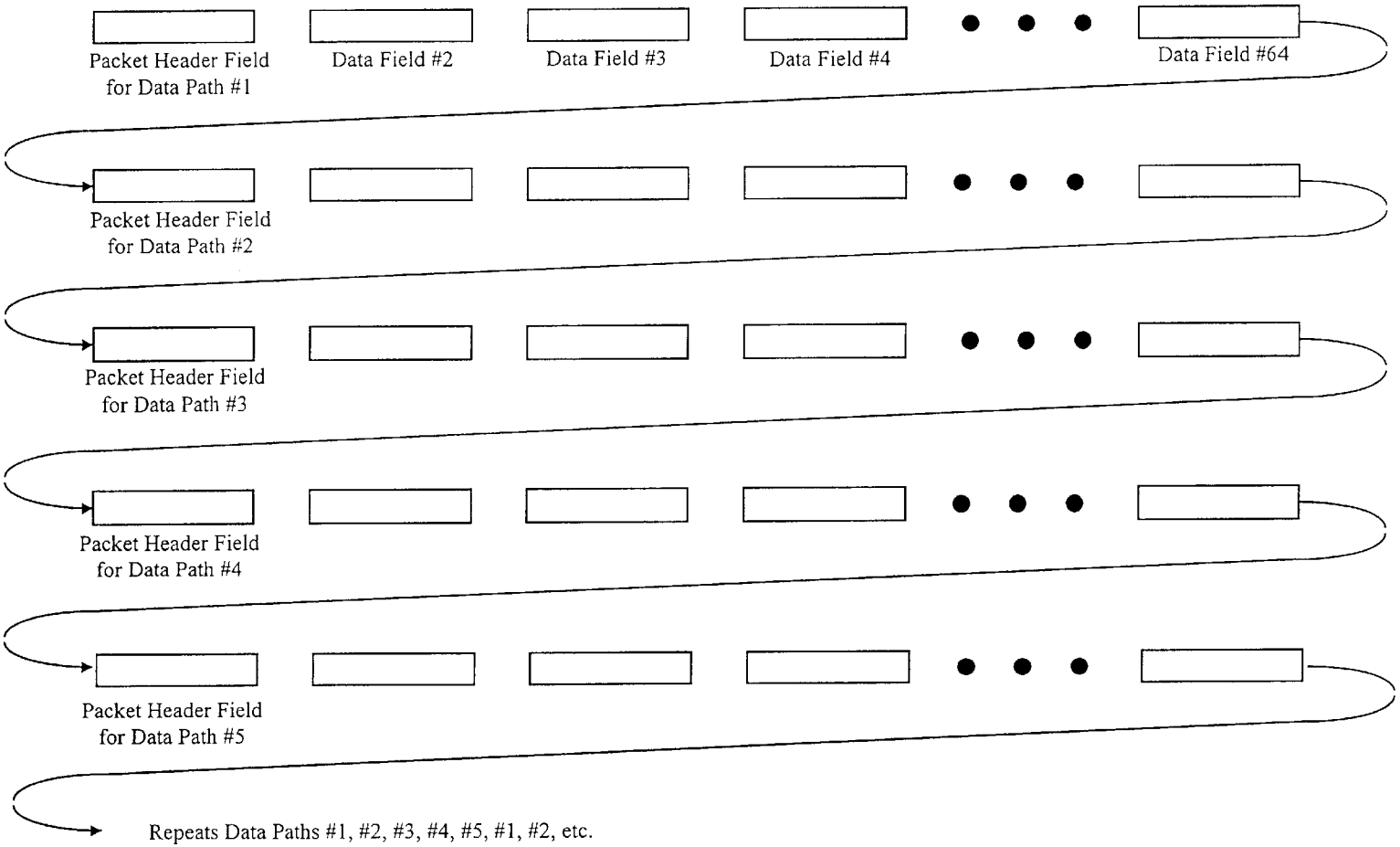
FIG. 13 illustrates the serial transmission of five packets of radio data.

FIG. 13 illustrates a simple serial transmission of MIDI data for five data paths within a radio broadcast. The packets of MIDI data are sent serially, and all five data paths are sent once every 64/60 seconds or 1.07 seconds. These packets will all be sent in-turn and are identified by the packet header field leading each packet.

For AM radio transmissions the signal bandwidth is limited, thus only five data paths will normally be broadcast. The preferred technique of RF carrier modulation for the traditional AM broadcast band, 540 kHz to 1700 kHz, is Quadrature Partial Response (QPR) which is well-known in the art-field. Other modulation and signaling types, however, may be used. The total bandwidth required to broadcast five data paths is plus and minus 3750 Hz about the carrier frequency, assuming using QPR and each accumulator period contains 64, six byte data fields. For FM radio transmissions the signal bandwidth is more generous. Therefore, five or more data paths may be broadcast. The preferred modulation scheme for the traditional FM broadcast band, 88 MHz to 108 MHz, is "tamed" FM, which is well-known in the art-field. Other modulation and signaling types, however, may be used. For wideband digital radio transmissions via satellite or terrestrial broadcasting, conventional digital modulations such as QPSK or BPSK may be used. The use of wideband, high data rate digital radio may require sharing the radio channel with other signals. It is understood that within the radio broadcast transmitter system 800, other, non-MIDI data may be produced or outputted and then combined at the data combiner processor 704, or at some other convenient interface, and then conveyed within the broadcast radio signal. This preferred embodiment indicates that the MIDI data and non-MIDI data are generated, processed, and combined in various steps, but it is possible that the data is generated and processed in parallel and combined together in one piece of equipment or that the data is generated and processed serially and combined serially.

Figure 14:
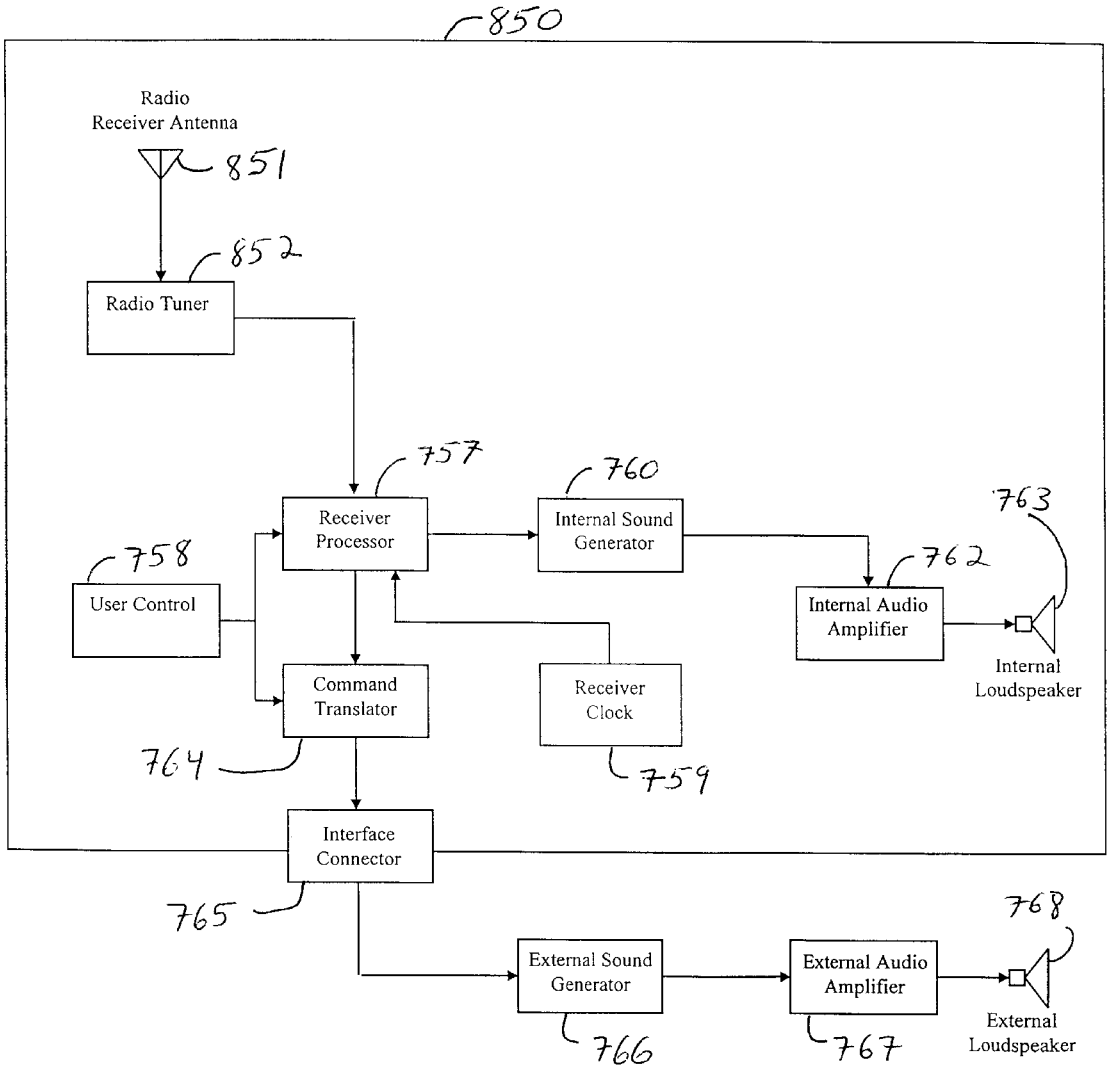
FIG. 14 is a block diagram of a radio receiver which includes a MIDI sound generator.

FIG. 14 illustrates a radio receiver 850 with a sound generator. The radio receiver antenna 851 received the radio signal with MIDI data and sends the radio signal with MIDI data to the radio tuner 852. The radio tuner selects the desired radio signal and outputs the MIDI data contained within the desired radio signal to the receiver processor 757. The receiver clock 759 provides timing signals to the receiver processor for a time reference.

The receiver processor performs the same functions in the radio system as in the television system (see FIG. 10). These functions include separating the MIDI data into data paths, detecting and correcting random bit errors and burst errors, placing the MIDI data in correct time position and appending each MIDI command with a receiver time tag data word based upon the timing signals from the receiver clock. These functions also include removing the random error detection and correction data, packet header fields, burst error detection and correction data, and time tag bytes. These functions also include passing the data through anti-ciphering logic and anti-command logic and automatic editing functions (censoring words and/or sounds, changing the loudness of data paths, MIDI channels, and sounds and/or words) and also inserting vocal "note-off" commands as required. The user can control which of the data paths and/or MIDI channels are sent to the internal sound generator 760 and/or to the command translator 764 by selecting the data paths and/or MIDI channels using the user control 758. The user, by inputting information into the user control, can choose which data paths and/or MIDI channels are to be sent to the internal sound generator and which are to be sent to an external sound generator through the command translator.

As with television, the radio receiver processor 757 sends the selected data paths and/or MIDI channels to an internal sound generator and/or through a command translator 764 and interface connector 765 to an external sound generator 766. Internal audio amplifier 762 and internal loudspeaker 763 and external audio amplifier 767 and external loudspeaker 768 may be downstream of the internal sound generator and external sound generator, respectively. The internal sound generator may use any available technique, such as sampled waveforms and/or one or more synthesizers, to generate the audio signal which is sent to the internal audio amplifier. Similarly, the external sound generator may use any available technique, such as sampled waveforms and/or one or more synthesizers, to generate the audio signal which is sent to the external audio amplifier.

It is understood that within the radio receiver 850 that other, non-MIDI data may be present within the received data signals. This other, non-MIDI data may also be detected by the radio tuner 852 and then passed to the other, non-MIDI data's respective processor.

This preferred embodiment indicates that the MIDI data and non-MIDI data are processed and outputted in various steps, but it is possible that the data is processed in parallel and outputted in one piece of equipment or that the data is processed serially and outputted. It is also possible that the receiver processes the MIDI data in various pieces of components.

It should be noted that although this preferred embodiment described two types of broadcast media for the transmission of the MIDI data, television and radio, other modes of broadcast transmitting of the MIDI data exist. One could utilize various broadcast transmission techniques to send the MIDI data to remote receivers. Some other broadcast transmission techniques include, but not limited to, fiber optic cables, radio frequency cable, microwave links, satellite broadcast systems, cellular telephone systems and over wide-area and local-area computer data networks.

Data Time-Lines

The timing of the MIDI data transmission is of particular importance for television broadcasts where synchronization between the sound and picture at a receiver is critical. In this preferred embodiment it is assumed that the picture signal is conveyed almost instantaneously from the video signal circuits 706 at the transmitter to the display 754 at the receiver 750. The MIDI data arriving at the signal combiner 705 has been delayed approximately one accumulator period from when the MIDI data was created by the data source 601 (see FIG. 7). The receiver 750 (see FIG. 10) further delays the MIDI data by an additional accumulator period while processing the MIDI data. Thus, for the MIDI data to arrive at the receiver's internal sound generator 760 or interface connector 765 at a time which is synchronized with the corresponding picture signal, the data source 601 must output the MIDI data at least two accumulator periods in advance of its presentation time at the receiver's internal sound generator or interface connector.

Figure 15:
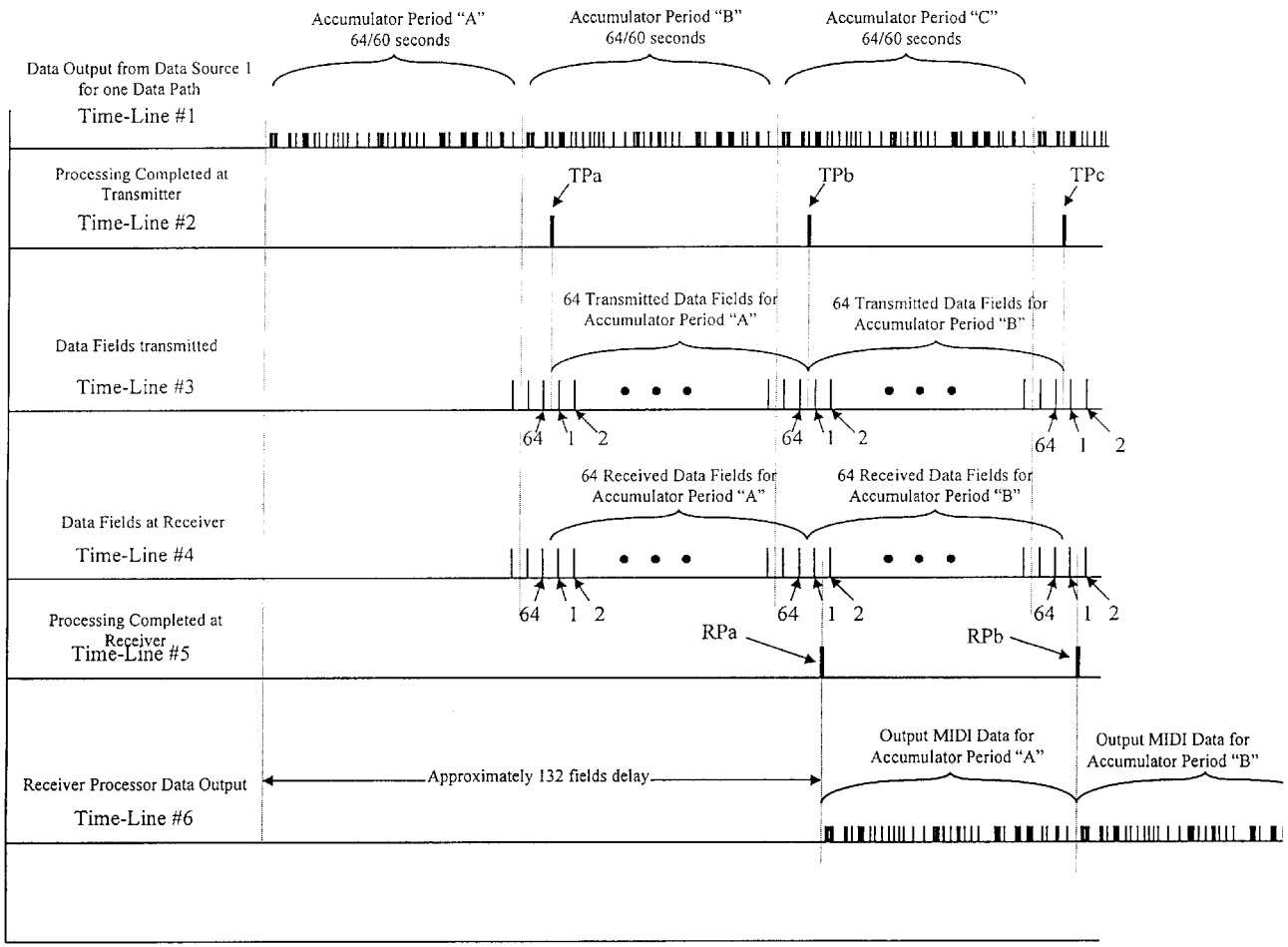
FIG. 15 Illustrates the timing of processing events within a transmitter and receiver.

FIG. 15 illustrates the time delays involved at the television transmitter and receiver for one data path. Time-Line 1 through Time-Line 6 are time-lines which illustrate events during the MIDI data processing at both the transmitter and receiver. The data source 601 continuously creates MIDI data. Each accumulator period, for each data path, can contain up to 44 MIDI instrumental commands or 22 MIDI vocal commands from the data source. Time-Line 1 illustrates three typical accumulator periods within a single data path for a television program, each one being 64/60 seconds in duration.

The first accumulator period illustrated is labeled "A", the second "B", and the third "C". After the completion of period "A", the MIDI data will reside within the transmitter processor 702, and each MIDI data command will have been given a time tag byte based upon the relative time within the accumulator period when it arrived. The subsequent insertion of the packet header field and burst error detection and correction data by the data combiner processor 704 will require some finite duration of time.

Time-Line 2 illustrates the completion of processing of accumulator period "A" by the transmitter 700 and is indicated by the symbol "TPa". The completion time of accumulator periods "B" and "C" are also illustrated by symbols "TPb" and "TPc". Once accumulator period "A" processing is complete, the MIDI data will reside in the signal combiner 705 and will be ready for transmission. There will be, for each data path, one packet header field, 44 MIDI data fields, and additional fields to accommodate burst error detection and correction data giving a total of 64 data fields, the total number within an accumulator period.

Time-Line 3 illustrates the broadcast transmission time for MIDI data within accumulator periods A and B. Shown are the 64 data fields at regular intervals as would occur with the conveyance of one data field within each of 64 NTSC picture fields or the conveyance of two data fields along with each of 32 digital television pictures.

Time-Line 4 illustrates the received time of the sixty-four data fields. These data fields will be delayed from Time-Line 3 only by the radio wave propagation time, normally 100 microseconds or less. Note that the picture signal will incur an equal radio wave propagation time delay because both the picture and the MIDI data are broadcast together and therefore this portion of the delay should not impact the picture and sound synchronization.

Time-Line 5 illustrates the completion time of processing at the receiver 750. The symbol "RPa" on Time-Line 5 illustrates the time at which the receiver's processing of MIDI data from period "A" is completed. Also shown is "RPb", the completion time for period "B". Note that for digital television the completion time at the receiver will be assumed to be the same as for NTSC transmissions. Although this time could be made shorter for digital television, it will normally be kept the same in order to provide a standardized system.

Once processing of accumulator period "A" MIDI data is complete, the MIDI data is available for output from the receiver processor 757. Time-Line 6 illustrates the output MIDI data. Actual output will commence after the first field of the next period. Therefore the MIDI data for accumulator period "A" will be presented to the listener starting during the first field in which accumulator period "B" MIDI data is being received and continuing for 64 fields to "RPb". At time "RPb", the presentation of MIDI data for period "B" will commence. The reason for delaying the presentation until the first field is to provide an adequate processing time at the receiver.

In summary, for MIDI data to arrive at the receiver's internal sound generator 760 or interface connector 765 at a time which synchronized with the corresponding picture signal, the data source 601 must output the MIDI data two accumulator periods plus approximately four field intervals in advance of its presentation time at the receiver's internal sound generator or interface connector. This time period is approximately 132 NTSC picture fields or 66 digital television pictures in advance as illustrated by Time-Line 6.

In an alternative embodiment, the invention allows the data source 601 to output the MIDI data further in advance of the proper presentation time. In this alternative embodiment, additional time code data must be included within the packet header or a system control command which is devised for that purpose. This additional time code data encodes an additional presentation time delay at the receiver 750 in terms of a specific number of field periods. Alternatively, the additional time code data could specify the additional delay in terms of seconds or some other convenient unit. It is also possible to specify the time of day at which the packet data is to be presented, or the picture field number within the current program at which packet data is to be presented. It is possible to combine these various techniques of identifying presentation time delays.

If a live television program is being broadcast, and a MIDI data language translation is being created real-time, then there will be greater than a two second delay in the audio derived from the MIDI data at a receiver. To compensate for this, the video should also be delayed by two or more seconds to provide a closer synchronization of the audio and picture of such a live program.

It is understood that the various functions performed by this preferred embodiment and alternative embodiments can be performed by software, by microprocessors, by algorithms, and/or by a combination thereof. It is also understood that the various separate components can be combined together so long as the combined unit performs the same functions as the separate components.

Supporting Theory

The number of MIDI commands within an accumulator period assumed above for instrumental and vocal music is realistic. According to the text "The MIDI Home Studio" by Massey, there are a maximum of 8,000 MIDI instrumental commands for a typical three minute music program, or approximately 44 MIDI instrumental commands per second. Within the preferred embodiment of the invention, an accumulator period for each data path will convey 44 instrumental or 22 vocal commands every 64/60 seconds. This amount corresponds to approximately 41 instrumental or 20 vocal commands per second. The three examples which follow demonstrate that 41 MIDI instrumental commands per second and that 20 MIDI vocal commands per second are acceptable rates.

EXAMPLE 1

"How lovely is Thy dwelling place", from "Re'quiem", by Johannes Brahms requires approximately 6,480 MIDI instrumental commands and requires about 6 minutes to perform at the recommended tempo of 92 beats per minute, giving an average MIDI command rate of 18 MIDI instrumental commands per second. The peak value of MIDI commands per second for this piece is observed to be about 25 MIDI instrumental commands per second.

EXAMPLE 2

"He, watching over Israel," from "Elijah," by Mendelssohn requires approximately 4,200 MIDI instrumental commands and requires about 2.5 minutes to perform at the recommended tempo of 120 beats per minute, giving an average MIDI command rate of 26 MIDI instrumental commands per second. The peak value of MIDI commands per second for this piece is about 37 MIDI instrumental commands per second.

EXAMPLE 3

"Glorious Day," by J. Martin and D. Angerman is an example of more modem music. This song requires approximately 4,300 MIDI instrumental commands and requires about 2.7 minutes to perform at a tempo of 92 beats per minute with some variations. The average MIDI command rate is 27 MIDI instrumental commands per second. Peak values of MIDI commands per second is observed to be about 45 MIDI instrumental commands per second.

Data rates for conversational speech are normally about 10 phonemes per second. If one requires both voice "note-on" and voice "note-off" commands, then the total number of commands per second for speech data is 20. The primary focus of the preferred embodiment of this invention is vocal lyrics for music as opposed to conversational speech, but conversational speech can be transmitted in the preferred embodiment. For vocal lyrics, the quantity of phonemes per second is governed by the tempo of the musical score. The number of phonemes per second can be estimated for a musical score by counting the number of letters in each word sung over a one second period. There is approximately one phoneme for each letter in English text. For the three examples above one can estimate the phoneme rates for these songs based upon the number of letters in the lyrics for each second of time lapsed. In the following list, the average and peak values of phonemes per second are given for the three songs:

Example 1) How Lovely is Thy Dwelling Place:
Avg=3.0/sec; Peak=7.0/sec

Example 2) He Watching Over Israel:
Avg=5.0/sec; Peak=12.0/sec

Example 3) Glorious Day:
Avg=8.5/sec; Peak=18.0/sec

A peak data rate of up to 18 phonemes per second for a single vocal part requires 36 voice "on" and "off" commands per second for that part. Because, however, a vocalist can only sing or speak one phoneme at a time, the data source 601 will delete all vocal "note-off" commands which are immediately followed by another vocal "note-on" command. Thus, the amount of broadcast data is reduced to an acceptable value of 18 vocal commands per second, a value below the 20 vocal commands per second maximum for each accumulator period within each data path.

While the invention has been particularly shown and described with reference to a preferred embodiment, it will be understood by those skilled in the art that various changes in form and detail may be made therein without departing from the scope and spirit of the invention.

I claim:

1. A method of broadcasting Musical Instrument Digital Interface (MIDI) formatted data for the control of a sound generator, comprising the steps of:

dividing a sequence of MIDI data commands into discrete packets occurring within a predetermined accumulator period of time;

modifying each of said MIDI data commands by labeling said commands with a time tag representing a relative time at which said MIDI data command occurs within its corresponding accumulator period;

encoding said modified MIDI data commands on a carrier wave for broadcasting to a remote receiver for the control of a sound generator.

2. A method for creating sound from a broadcast carrier signal encoded in accordance with the method of claim 1, comprising the steps of:

receiving said boardcast carrier signal and decoding the encoded modified MIDI data commands transmitted therein;

sequencing said decoded MIDI data commands within their accumulator periods in accordance with the time tag representing a relative time at which said MIDI data command was encoded within its accumulator period;

outputting said sequenced MIDI data commands to sound generator.

3. A method for creating sound as recited in claim 2 further comprising:

analyzing said transmitted decoded MIDI data commands for vocal "note-on" commands;

and adding a vocal "note-off" command prior to each said vocal "note-on" command.

4. A method for creating sound as recited in claim 2 further comprising the steps of:

identifying one or more sounds;

determining a standard formatted MIDI code corresponding to each of said identified sounds;

comparing said transmitted encoded MIDI data commands to said predetermined standard formatted MIDI codes for said identified sounds; and isolating said transmitted encoded MIDI data commands that match said predetermined standard formatted MIDI codes for identified sounds.

5. A method for creating sound as recited in claim 4 further comprising the step of:

after isolating said transmitted encoded MIDI data commands that match said predetermined standard formatted MIDI codes for said identified sounds, changing loudness data for said transmitted encoded MIDI data commands.

6. A method for creating sound as recited in claim 4 further comprising the steps of:

designating one or more substitute sounds to replace said identified sounds;

generating standard formatted MIDI data encoding for said substitute sounds;

replacing said transmitted encoded MIDI data commands that match said predetermined standard formatted MIDI codes for said identified sounds with said generated MIDI data encoding for said substitute sounds.

7. The method of broadcasting data as recited in claim 1, wherein said sequence of MIDI data commands code for two different sound tracks, and said step of dividing the sequence of data commands further comprises the step of functionally grouping a first sound track into a first packet of MIDI data and functionally grouping a second sound track into a second packet of MIDI data.

8. The method of broadcasting data as recited in claim 7, wherein said first and second sound tracks are voice tracks that encode for different languages.

9. The method of transmitting data as recited in claim 1, wherein said data represents modified MIDI data corresponding to a modified MIDI data format.

10. The method of transmitting data as recited in claim 9, wherein the discrete portions of said modified MIDI data include vocal "note-off" commands and vocal "note-on" commands, and said method further comprises the step prior to dividing said data into accumulator periods of deleting selected vocal "note-off" commands that are immediately followed by a vocal "note-on" command.

11. A method for producing sound from data broadcast in accordance with the method of claim 9, wherein said modified MIDI data encodes for instrumental music and elemental vocal sounds, said method comprising the steps of:

receiving and decoding said modified MIDI data from said carrier wave;

placing the discrete portions of said decoded modified MIDI data into a proper time position relative to other such portions based on the accumulator period of each discrete portion and time tag with which said discrete portion was labeled;

conveying said modified MIDI data to a sound generator.

12. A receiver for receiving a broadcast carrier signal encoded in accordance with the method of claim 1, and for decoding modified MIDI data commands therefrom, said receiver further comprising a receiver processor for dividing said modified MIDI data commands into said discrete packets based on their accumulator periods and for sequencing said modified MIDI data commands within their accumulator periods in accordance with the time tag representing a relative time at which said modified MIDI data command was encoded within its accumulator period.

13. A method of producing speech and music vocals comprising the steps of:

dividing speech and music vocals into elemental vocal sounds;

encoding said elemental vocal sounds into modified MIDI data commands inclusive of vocal "note-off" commands and vocal "note-on" commands;

selectively deleting "note-off" commands when immediately followed by a "note-on" command; and conveying said encoded modified MIDI data commands to a sound generator for production of sound.

14. A method for producing sound from data broadcast in accordance with the method of claim 9, wherein said modified MIDI data commands encode for instrumental music and elemental vocal sounds, said method comprising the steps of:

receiving and decoding said modified MIDI data from said carrier wave;

placing the discrete portions of said decoded modified MIDI data into a proper time position relative to other such portions based on the accumulator period of each discrete portion and time with which said discrete portion was labeled;

assessing a data bit error rate;

determining an anti-ciphering time delay;

outputting said decoded modified MIDI data to a sound generator;

waiting for said anti-ciphering time delay to expire; and outputting to said sound generator "note-off" command if said anti-ciphering time delay expires.

15. The method for producing sound from data according to claim 14, wherein said anti-ciphering time delay is a function of said data bit error rate.

16. The method for producing sound from data according to claim 14, further comprising the step of dividing said transmitted modified MIDI data into at least two groups of phonemes including consonants and vowels, said anti-ciphering time delay being determined for each said group of phonemes.

17. The method for producing sound from data according to claim 14, further comprising the step of determining a duration of at least one vocal music note, said anti-ciphering time delay being a function of said duration.

18. The method for producing sound from data according to claim 14, further comprising the step of determining a duration of at least one instrumental music note, said anti-ciphering time delay being a function of said duration.

19. The method for producing sound from data according to claim 14, further comprising the step of determining a duration of at least one elementary speech sound, said anti-ciphering time delay being a function of said duration.

20. A method for broadcasting Musical Instrument Digital Interface (MIDI) formatted data comprising the steps of:

encoding sound as discrete MIDI data commands;

dividing said encoded MIDI data commands into a plurality of discrete packets occurring within predetermined-duration accumulator periods and modifying each divided MIDI data command by tagging said MIDI data command with a time tag representing a relative time at which said modified MIDI data command occurs within its corresponding accumulator period;

encoding said modified MIDI data on a broadcast carrier signal;

receiving said broadcast carrier signal and decoding said modified MIDI data commands;

sequencing said modified MIDI data commands in accordance with their accumulator period and time tags;

controlling a sound generator in accordance with said sequenced modified MIDI data commands to generate chronological sounds.

21. The method for broadcasting sound as recited in claim 20 further comprising the step of detecting errors in said modified MIDI data commands after decoding said modified MIDI data commands from said broadcast carrier signal.

22. The method for broadcasting sound as recited in claim 21, wherein said step of controlling said sound generator in accordance with said time tags further comprises compensating for said errors.

23. The method for broadcasting sound as recited in claim 20, wherein said step of decoding said modified MIDI data commands further comprises separating said modified MIDI data commands into a plurality of data paths, and selecting at least one of said data paths, and said step of outputting said modified MIDI data to a sound generator further comprises outputting the selected modified MIDI data commands to said sound generator.

24. The method for broadcasting sound as recited in claim 23, wherein said modified MIDI data commands encode a plurality of programs, and the modified MIDI data commands corresponding to each program are separated into a corresponding data path.

25. The method for broadcasting sound as recited in claim 23, wherein said modified MIDI data commands encode a plurality of different languages, and said modified MIDI data commands corresponding to each language are separated accordingly into separate voice tracks corresponding to said respective languages.

26. The method for broadcasting sound as recited in claim 20, further comprising the step of changing loudness data for a modified MIDI command prior to outputting said modified MIDI data command to said sound generator.

27. The method for broadcasting sound as recited in claim 20, further comprising the steps of replacing selected modified MIDI commands with substitute modified MIDI commands, encoding substitute sounds and outputting the substitute modified MIDI data command to said sound generator.

28. A method for producing of speech and music vocals by transmitting Musical Instrument Digital Interface (MIDI) formatted data, said method comprising the steps of:

dividing speech and music vocals into elemental vocal sounds;

encoding each of said elemental vocal sounds into standard formatted MIDI data commands, and for each elemental vocal sound generating a preceding "note-on" command and selectively generating a subsequent "note-off" command only when not immediately followed by a "note-on" command;

outputting the MIDI data commands with "note-on" and "note-off" commands to a sound generator for decoding of said elemental vocal sounds and production of speech and music vocals.

29. A method for creating sound from transmitted modified MIDI data, said modified MIDI data having been transmitted with time tags and in accumulator periods from a remote transmitter, said method comprising the steps of:

receiving said transmitted modified MIDI data;

placing said transmitted modified MIDI data into the proper time position within said accumulator periods;

assessing a data bit error rate;

comparing said assessed data bit error rate to predetermined values;

suppressing specified modified MIDI data when said assessed data bit error rate exceeds said predetermined values; and outputting non-suppressed modified MIDI data to a sound generator.

* * * * *